US010088216B2

(12) United States Patent
Chae et al.

(10) Patent No.: US 10,088,216 B2
(45) Date of Patent: Oct. 2, 2018

(54) REFRIGERATOR AND METHOD OF CONTROLLING THE SAME

(71) Applicant: LG ELECTRONICS INC., Seoul (KR)

(72) Inventors: Sunam Chae, Seoul (KR); Kyungseok Kim, Seoul (KR); Soyoon Kim, Seoul (KR); Heekwon Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/398,769

(22) Filed: Jan. 5, 2017

(65) Prior Publication Data

US 2017/0191727 A1 Jul. 6, 2017

(30) Foreign Application Priority Data

Jan. 5, 2016 (KR) ..... 10-2016-0000950
Jun. 10, 2016 (KR) ..... 10-2016-0072600

(51) Int. Cl.
*F25D 11/02* (2006.01)
*F25D 29/00* (2006.01)
(Continued)

(52) U.S. Cl.
CPC ..... *F25D 11/022* (2013.01); *F25B 5/02* (2013.01); *F25B 5/04* (2013.01); *F25B 40/00* (2013.01);
(Continued)

(58) Field of Classification Search
CPC .... F25D 11/022; F25D 29/00; F25D 2600/04; F25D 2700/12; F25B 5/02; F25B 40/00; F25B 2341/0662; F25B 2400/0409; F25B 2400/0411; F25B 2400/052; F25B 2400/054
USPC ..... 62/199
See application file for complete search history.

(56) References Cited

U.S. PATENT DOCUMENTS 4,439,996 A * 4/1984 Frohbieter ..... F25B 5/04 62/174
5,150,583 A * 9/1992 Jaster ..... F25B 1/10 62/179
(Continued)

FOREIGN PATENT DOCUMENTS

EP 0541324 5/1993
EP 1577621 9/2005
(Continued)

OTHER PUBLICATIONS

Extended European Search Report in European Application No. 17150282.6, dated May 8, 2017, 7 pages (with English translation).

*Primary Examiner* — Mohammad M Ali
(74) *Attorney, Agent, or Firm* — Fish & Richardson P.C.

(57) ABSTRACT

A refrigerator that includes a compressor configured to compress a refrigerant; a condenser configured to condense the refrigerant; a first evaporator that is configured to evaporate the refrigerant, the evaporated refrigerant being configured to cool a refrigerating compartment; a second evaporator that is configured to evaporate the refrigerant, the evaporated refrigerant being configured to cool a freezing compartment; a first heat exchanger; a refrigerating-compartment expansion device that is coupled to the first heat exchanger and that is configured to expand the refrigerant and provide the expanded refrigerant to the first heat exchanger; a second heat exchanger coupled to the second evaporator; and a freezing-compartment expansion device that is coupled to the second heat exchanger and that is configured to expand the refrigerant and provide the expanded refrigerant to the second heat exchanger, wherein the first heat exchanger is configured to cool the second heat exchanger is disclosed.

24 Claims, 14 Drawing Sheets

(51) Int. Cl.

| | |
|---|---|
| ***F25B 5/02*** | (2006.01) |
| ***F25B 5/04*** | (2006.01) |
| ***F25B 40/00*** | (2006.01) |
| ***F25B 41/04*** | (2006.01) |
| ***F25B 41/06*** | (2006.01) |

(52) U.S. Cl.

CPC ..... *F25B 41/04* (2013.01); *F25B 41/067* (2013.01); *F25D 29/00* (2013.01); *F25B 2341/0662* (2013.01); *F25B 2400/0409* (2013.01); *F25B 2400/0411* (2013.01); *F25B 2400/052* (2013.01); *F25B 2400/054* (2013.01); *F25D 2600/04* (2013.01); *F25D 2700/12* (2013.01)

(56) References Cited

U.S. PATENT DOCUMENTS 5,251,455 A 10/1993 Cur et al.
5,261,247 A * 11/1993 Knezic ..... F25D 11/022 62/117
5,388,427 A * 2/1995 Lee ..... F25D 17/065 165/63
5,477,915 A * 12/1995 Park ..... F25B 5/04 165/206
6,568,198 B1 * 5/2003 Tadano ..... F25B 1/10 62/217
8,511,109 B2 * 8/2013 Kuehl ..... F25D 16/00 62/332
8,863,533 B2 * 10/2014 Oh ..... F25B 1/10 62/468
2002/0069654 A1 * 6/2002 Doi ..... F25B 1/10 62/199
2004/0003613 A1 * 1/2004 Shin ..... F25D 11/022 62/199

FOREIGN PATENT DOCUMENTS

| | | |
|---|---|---|
| EP | 2278239 | 1/2011 |
| EP | 2868997 | 5/2015 |
| JP | 2013-092291 | 5/2013 |
| WO | 98-03825 | 1/1998 |
| WO | 2008-078876 | 7/2008 |

* cited by examiner

REFRIGERATOR AND METHOD OF CONTROLLING THE SAME

CROSS-REFERENCE TO RELATED APPLICATION

The application claims priority under 35 U.S.C. § 119 and 35 U.S.C. § 365 to Korean Patent Application No. 10-2016-0000950 filed on Jan. 5, 2016 and Korean Patent Application No. 10-2016-0072600 filed on Jun. 10, 2016, the entire content of the prior applications is hereby incorporated by reference.

TECHNICAL FIELD

The present application generally relates to refrigerator control technology.

BACKGROUND

In general, a refrigerator includes a plurality of storage compartments for storing a storage to be refrigerated or frozen, and one surface of each of the storage compartments is opened such that food can be inserted and withdrawn. The plurality of storage compartments includes a freezing compartment for freezing food and a refrigerating compartment for refrigerating food.

In a refrigerator, a freezing system in which refrigerant is circulated is driven. An apparatus configuring the freezing system includes a compressor, a condenser, an expansion device and an evaporator. The evaporator may include a first evaporator provided at one side of the refrigerating compartment and a second evaporator provided at one side of the freezing compartment.

Recently, a refrigerator including evaporators and expansion devices individually provided in freezing and refrigerating compartments was developed. This refrigerator controls each expansion device to adjust the amount of refrigerant supplied to each evaporator in a compressor, thereby respectively maintaining the internal temperatures of the freezing and refrigerating compartments at freezing and refrigerating temperatures.

SUMMARY

The present disclosure is related to a refrigerator for selectively performing load shift according to the load thereof and a method of controlling the same.

In general, one innovative aspect of the subject matter described in this specification can be embodied in a refrigerator including a compressor configured to compress a refrigerant; a condenser configured to condense the refrigerant; a first evaporator that is configured to evaporate the refrigerant condensed by the condenser, the evaporated refrigerant being configured to cool a refrigerating compartment; a second evaporator that is configured to evaporate the refrigerant condensed by the condenser, the evaporated refrigerant being configured to cool a freezing compartment; a first heat exchanger coupled to the first evaporator; a refrigerating-compartment expansion device that is coupled to the first heat exchanger and that is configured to expand the refrigerant and provide the expanded refrigerant to the first heat exchanger; a second heat exchanger coupled to the second evaporator; and a freezing-compartment expansion device that is coupled to the second heat exchanger and that is configured to expand the refrigerant and provide the expanded refrigerant to the second heat exchanger, wherein the first heat exchanger is configured to cool the second heat exchanger.

The foregoing and other embodiments can each optionally include one or more of the following features, alone or in combination. In particular, one embodiment includes all the following features in combination. The freezing-compartment expansion device includes: a first expansion device coupled to an inlet side of the second heat exchanger, and a second expansion device coupled to an outlet side of the second heat exchanger, and wherein the refrigerant expanded by the second expansion device passes through the second evaporator. The refrigerator further includes a suction pipe that is configured to couple the second evaporator to the compressor, wherein the first expansion device, the second expansion device, and the suction pipe exchange heat with each other. A first surface of the first heat exchanger and a first surface of the second heat exchanger are coupled together. The refrigerator further includes a valve device that couples the condenser to the second heat exchanger and that is configured to control an amount of the refrigerant provided from the condenser to the second heat exchanger. The refrigerator further includes a first expansion device that is coupled to a first outlet side of the valve device and that is configured to expand the refrigerant that is provided to the second heat exchanger; and a second expansion device that is coupled to an outlet side of the second heat exchanger and that is configured to expand the refrigerant that is output from the second heat exchanger. The refrigerator further includes a third expansion device that is coupled to a second outlet side of the valve device and that is configured to expand the refrigerant that bypasses the second heat exchanger. Each of the first expansion device, the second expansion device, and the third expansion devices includes a respective capillary tube, and wherein a diameter of the capillary tube of the third expansion device is greater than a diameter of the capillary tube of the first expansion device or a diameter of the capillary tube of the second expansion device. The valve device includes a first valve including a first inlet, a first outlet, and a second outlet, and wherein the first valve is coupled to a first flow channel that extends from the first outlet of the first valve and that is coupled to the first expansion device, the second expansion device, and the second heat exchanger; and a second flow channel that extends from the second outlet of the first valve and that is coupled to the third expansion device. The refrigerator further includes: a coupler that couples the first flow channel to the second flow channel, wherein the coupler is coupled to an inlet side of the second evaporator. The compressor includes a first compressor configured to draw first refrigerant of the refrigerant and compress the first refrigerant, and a second compressor configured to draw second refrigerant of the refrigerant and compress the second refrigerant, and wherein the condenser includes a first condenser that is coupled to an outlet side of the first compressor and that is configured to condense the first refrigerant, and a second condenser that is coupled to an outlet side of the second compressor and that is configured to condense the second refrigerant. The compressor includes a first compressor, and a second compressor configured to draw second refrigerant of the refrigerant and compress the second refrigerant, and wherein the first compressor is configured to (i) draw first refrigerant of the refrigerant, the first refrigerant being evaporated by the first evaporator and (ii) compress the first refrigerant and the second refrigerant. The refrigerator further includes a second valve that includes a first inlet, a first outlet, a second outlet, and a third outlet, wherein the second valve is coupled to a first flow channel that extends from the first outlet of the second valve to the first heat exchanger; a second flow channel that extends from the second outlet of the second valve to the second heat exchanger; and a third flow channel that extends from the third outlet of the second valve to the second evaporator. The refrigerator further includes a refrigerating-compartment expansion device that is provided in the first flow channel and that is coupled to the first heat exchanger; a first expansion device that is provided in the second flow channel and that is coupled to the second heat exchanger; and a second expansion device that is provided in the second flow channel and that is coupled to the second heat exchanger. The refrigerator further includes: a third expansion device provided in the third flow channel.

In general, another innovative aspect of the subject matter described in this specification can be embodied in a method of controlling a refrigerator that includes (i) a first compressor, a first condenser, a first heat exchanger, and a first evaporator for a refrigerating-compartment cycle and (ii) a second compressor, a second condenser, a second heat exchanger, a freezing-compartment expansion device, and a second evaporator for a freezing-compartment cycle, wherein the first heat exchanger is configured to cool the second heat exchanger, the method including operations of sensing a temperature of an indoor space of the refrigerator; sensing cooling capacity of the second compressor; and controlling an amount of a refrigerant provided to the second heat exchanger based on the temperature of the indoor space or the cooling capacity of the second compressor.

The foregoing and other embodiments can each optionally include one or more of the following features, alone or in combination. In particular, one embodiment includes all the following features in combination. The method further includes determining that the cooling capacity of the second compressor satisfies a threshold cooling capacity; providing the refrigerant to the second heat exchanger based on the determination that the cooling capacity of the second compressor satisfies the threshold cooling capacity; and providing the refrigerant to the second evaporator based on the determination that the cooling capacity of the second compressor satisfies the threshold cooling capacity. The method further includes decompressing the refrigerant that is provided to the second heat exchanger; and decompressing the refrigerant that is provided to the second evaporator. The method further includes exchanging heat among (i) a suction pipe that extends from the second evaporator to the second compressor and (ii) one or more expansion devices of the freezing-compartment expansion device. The method further includes providing the refrigerant into two different channels using a three-way valve.

BRIEF DESCRIPTION OF THE DRAWINGS

Like reference numbers and designations in the various drawings indicate like elements

DETAILED DESCRIPTION

Figure 1:
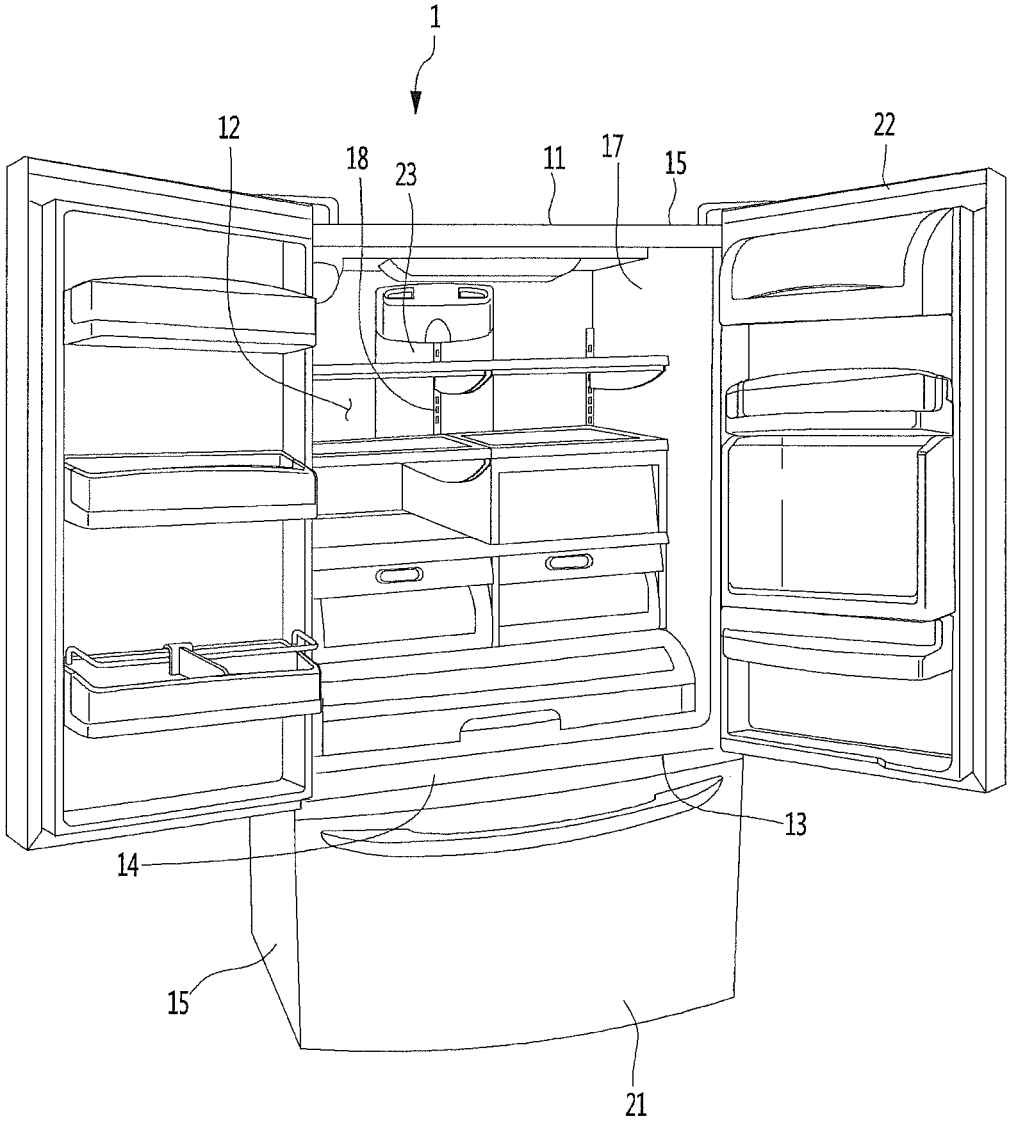
FIG. 1 is a diagram illustrating an example refrigerator.

FIG. 1 illustrates an example refrigerator. Referring to FIG. 1, a refrigerator 1 includes a main body 11 having an openable front surface and forming storage compartments 12 and 13. The storage compartments include the refrigerating compartment 12 and the freezing compartment 13, and the refrigerating compartment 12 and the freezing compartment 13 may be partitioned by a partition 14. The refrigerating compartment 12 and the freezing compartment 13 may be referred to as a "first storage compartment" and a "second storage compartment", respectively.

The main body 11 may include an outer case 15 forming the appearance of the refrigerator 1, a refrigerating-compartment inner case 16 provided inside the outer case 15 and forming the inside of the refrigerating compartment 12 and a freezing-compartment inner case (not shown) provided inside the outer case 15 and forming the inside of the freezing compartment 13. An insulation material may be provided in a space between the outer case 15 and the freezing-compartment inner case 16 and a space between the outer case 15 and the freezing-compartment inner case.

In addition, the refrigerator 1 may further include a freezing-compartment door 21 and a refrigerating-compartment door 22 coupled to the front side of the main body 11 to selectively shield the freezing compartment 13 and the refrigerating compartment 12.

In some implementations, for example, a bottom freezer type refrigerator in which a freezing compartment is provided under a refrigerating compartment will be described. However, the present application is not limited to the bottom freezer type refrigerator and is applicable to a top mount type refrigerator in which a freezing compartment is provided on a refrigerating compartment and a side-by-side type refrigerator in which a freezing compartment and a refrigerating compartment are provided side by side.

The refrigerating compartment 12 may include a cool-air discharger 18 for discharging air cooled in a first evaporator 140 to the refrigerating compartment 12. The cool-air discharger 18 may be provided on the rear surface of the refrigerating compartment 12 and may be formed on a refrigerating-compartment cover plate 23. A freezing-compartment cover plate (not shown), on which a cool-air discharger (not shown) for discharging cool air is formed, may be provided on the rear surface of the freezing compartment 13.

Figure 2:
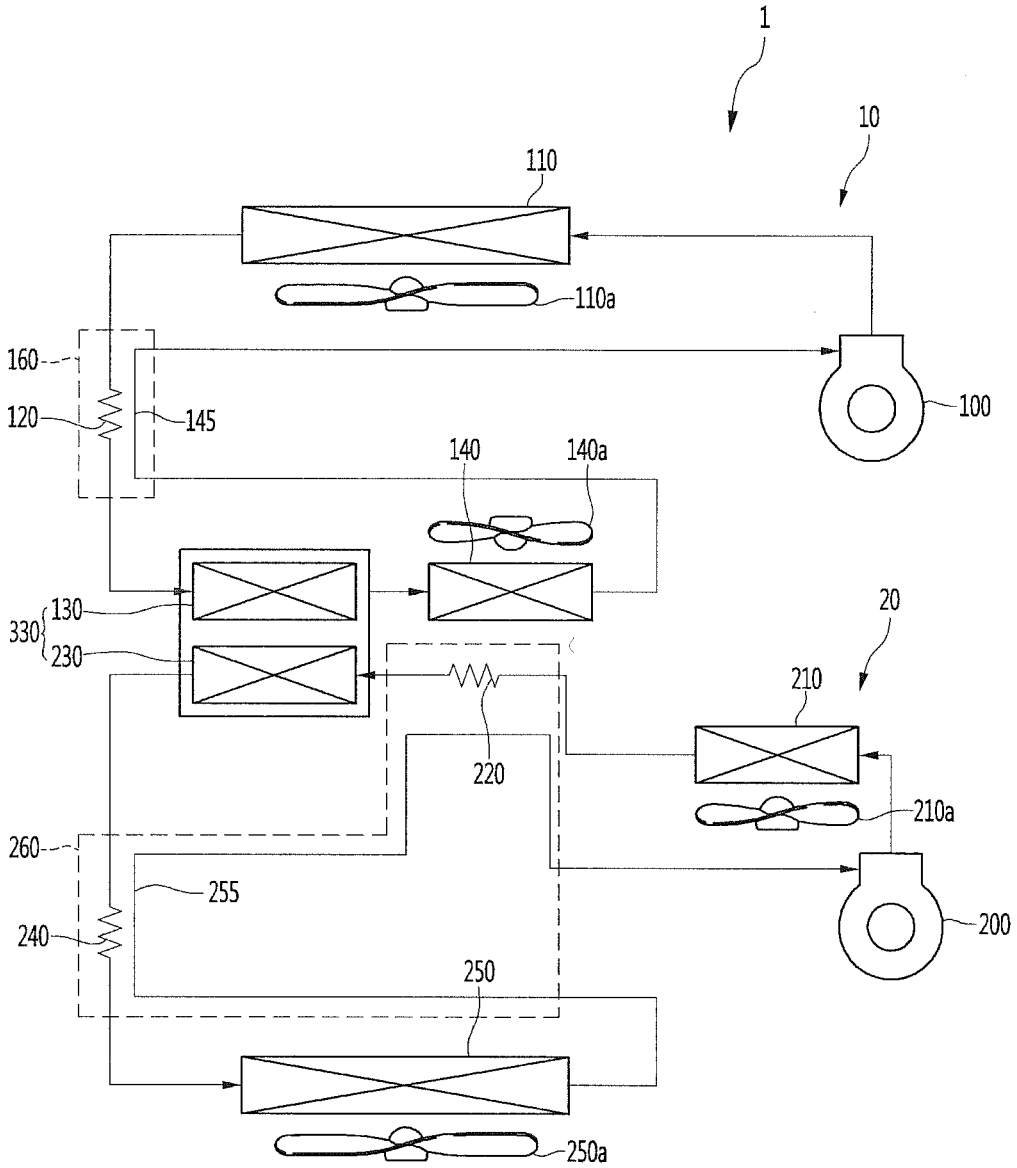
FIG. 2 is a diagram illustrating an example freezing cycle of a refrigerator.
Figure 3:
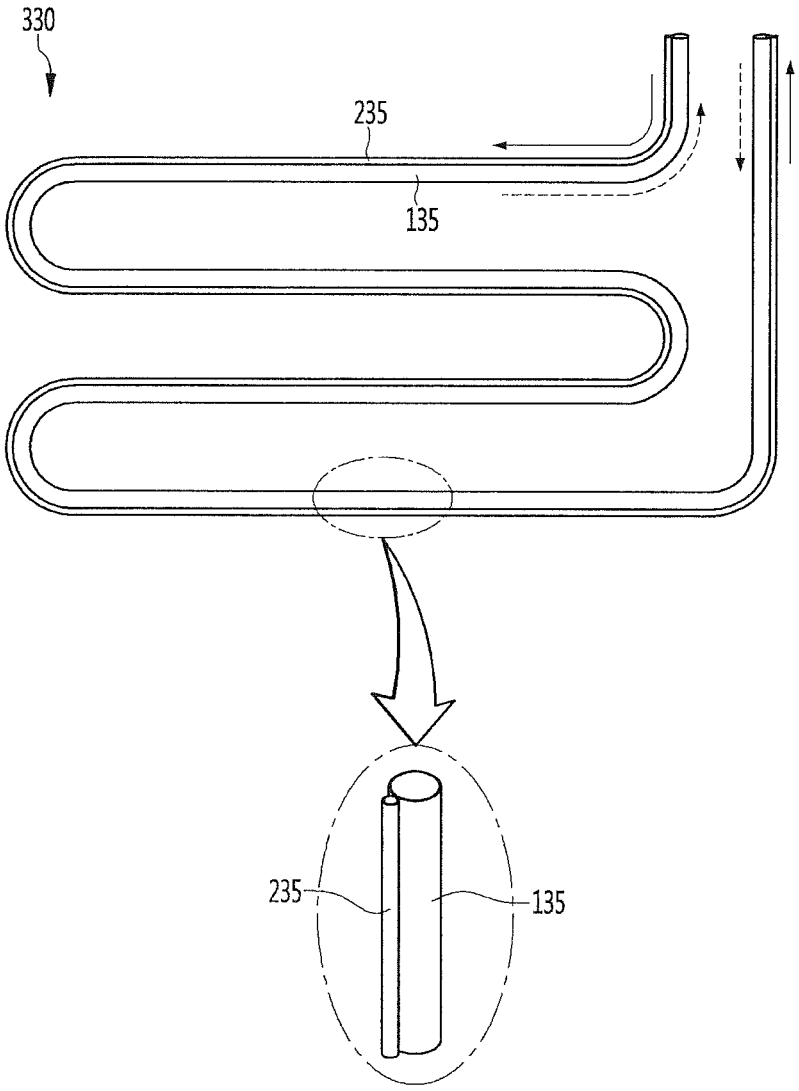
FIG. 3 is a diagram illustrating an example heat exchanger.
Figure 4:
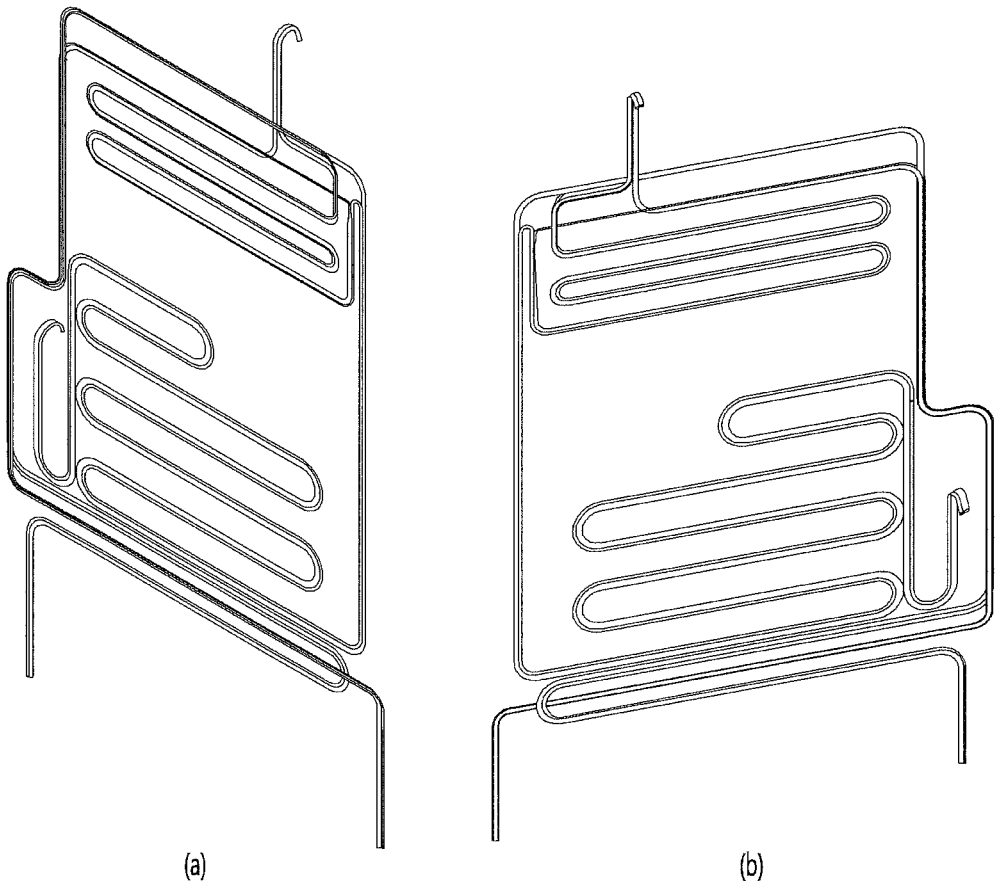
FIG. 4 is a diagram illustrating example arrangements of refrigerant pipes.
Figure 5:
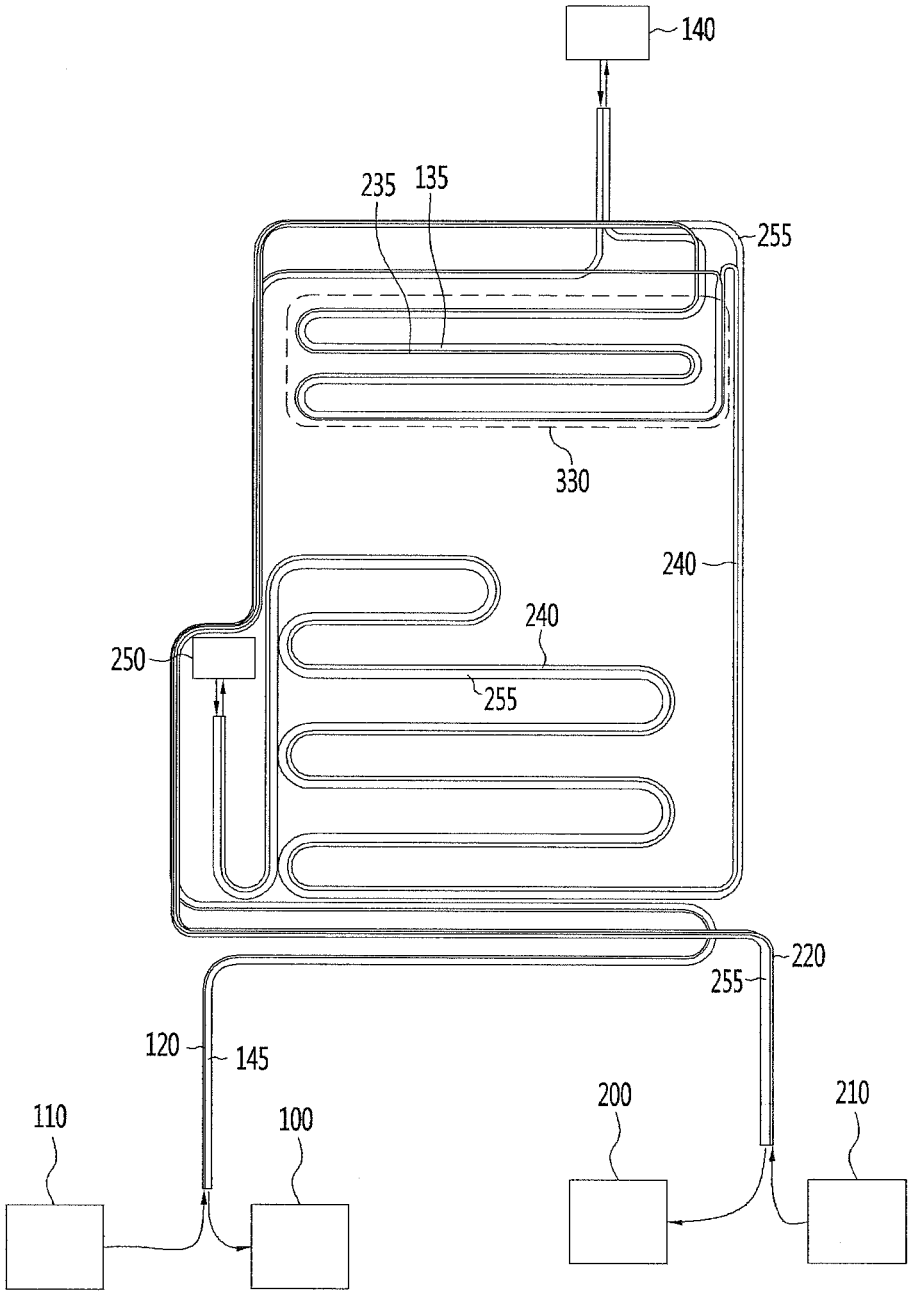
FIG. 5 is a diagram illustrating an example refrigerator.
Figure 6:
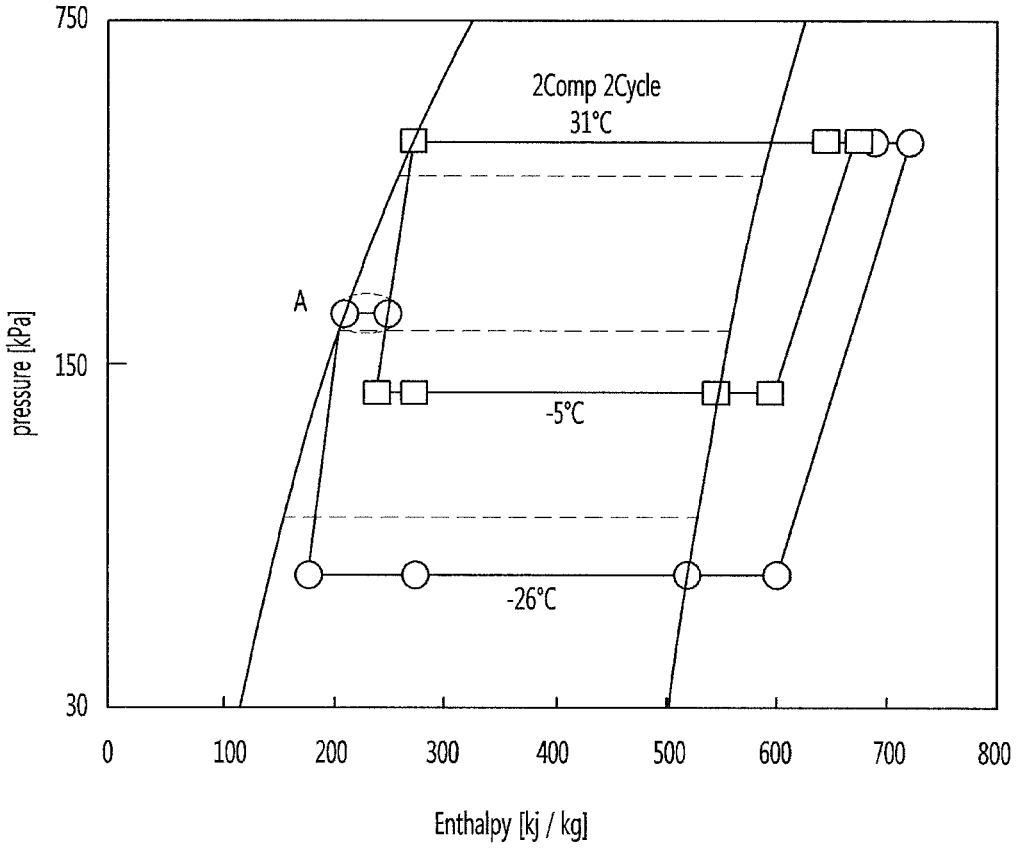
FIG. 6 is a graph illustrating an example P-H curve with reference to FIG. 2.

FIG. 2 illustrates an example freezing cycle of a refrigerator. FIG. 3 illustrates an example heat exchanger. FIG. 4 illustrates example arrangements of refrigerant pipes. FIG. 5 illustrates an example refrigerator. FIG. 6 illustrates a graph showing an example P-H curve with reference to FIG. 2.

First, referring to FIG. 2, the refrigerator 1 includes a refrigerating-compartment cycle 10 for operating the refrigerating cycle for cooling the refrigerating compartment 12 and a freezing-compartment cycle 20 for operating the refrigerating cycle for cooling the freezing compartment 13. First refrigerant may be circulated in the refrigerating-compartment cycle 10 and second refrigerant may be circulated in the freezing-compartment cycle 20. The first and second refrigerants are not mixed or distributed to form independent cycles.

More specifically, the freezing-compartment cycle 10 includes a first compressor 100 as a "refrigerating-compartment compressor" for compressing the first refrigerant into high-temperature, high-pressure refrigerant, a first condenser 110 for condensing the high-temperature, high-pressure first refrigerant compressed by the first compressor 100 through heat radiation, a refrigerating-compartment expansion device 120 for decompressing the refrigerant condensed by the first condenser 110, and a first evaporator 140 for evaporating the refrigerant decompressed by the refrigerating-compartment expansion device 120.

The first condenser 110 may be provided in a mechanical compartment located at the rear side of the freezing compartment 13 as a "refrigerating-compartment condenser". A first condensing fan 110*a* may be provided at one side of the first condenser 110. The first condensing fan 110*a* may operate such that air in the mechanical compartment or air in an indoor space provided in the refrigerator flows toward the first condenser 110.

The refrigerating-compartment expansion device 120 may include a capillary tube. The capillary tube has a relatively small diameter. The capillary tube may act as resistance to the flow of the refrigerant when the refrigerant passes through the capillary tube, thereby expanding the refrigerant. A first heat exchanger 130 may be provided between the refrigerating-compartment expansion device 120 and the first evaporator 140. That is, the refrigerating-compartment expansion device 120 may be provided at the inlet side of the first heat exchanger 130 and the first evaporator 140 may be provided at the outlet side of the first heat exchanger 130.

The first evaporator 140 may be provided at the rear side of the refrigerating compartment 12 as a "refrigerating-compartment evaporator". A first evaporation fan 140*a* may be provided at one side of the first evaporator 140. The first evaporation fan 140*a* may operate such that cool air in the refrigerating compartment 12 flows toward the first evaporator 140. Air cooled while passing through the first evaporator 140 may flow into the refrigerating compartment 12 again.

The freezing-compartment cycle 20 includes a second compressor 200 as a "freezing-compartment compressor" for compressing the second refrigerant into high-temperature, high-pressure refrigerant, a second condenser 210 for condensing the high-temperature, high-pressure second refrigerant compressed by the second compressor 200 through heat radiation, freezing-compartment expansion devices 220 and 240 for decompressing the refrigerant condensed by the second condenser 210 and a second evaporator 250 for evaporating the refrigerant decompressed by the freezing-compartment expansion devices 220 and 240.

The second condenser 210 may be provided in a mechanical compartment located at the rear side of the freezing compartment 13 as a "freezing-compartment condenser". A second condensing fan 210*a* may be provided at one side of the second condenser 210. The second condensing fan 210*a* may operate such that air in the mechanical compartment or air in an indoor space provided in the refrigerator flows toward the second condenser 210.

The freezing-compartment expansion devices 220 and 240 include a plurality of expansion devices. The plurality of expansion devices includes the first expansion device 220 and the second expansion device 240. Each of the first and second expansion devices 220 and 240 may include a capillary tube. A second heat exchanger 230 is provided between the first expansion devices 220 and 240. That is, the first expansion device 220 may be provided at the inlet side of the second heat exchanger 230 and the second expansion device 240 may be provided at the outlet side of the second heat exchanger 230.

The second evaporator 250 may be provided at the rear side of the freezing compartment 12 as a "freezing-compartment evaporator". A second evaporation fan 250*a* may be provided at one side of the second evaporator 250. The second evaporation fan 250*a* may operate such that cool air in the freezing compartment 13 flows toward the second evaporator 250. Air cooled while passing through the second evaporator 250 may flow into the freezing compartment 12 again. The first evaporator 140 may be referred to as a "refrigerating-compartment evaporator" and the second evaporator 250 may be referred to as a "freezing-compartment evaporator".

The refrigerator 1 may further include a device for shifting a load required for the freezing-compartment cycle 20 to the refrigerating-compartment cycle 10. More specifically, the refrigerator 1 further includes an intermediate heat exchange unit 330 for exchanging heat between the refrigerating-compartment cycle 10 and the freezing-compartment cycle 20.

The intermediate heat exchange unit 330 includes a first heat exchanger 130 provided in the refrigerating-compartment cycle 10 and a second exchanger 230 provided in the freezing-compartment cycle 20. Heat may be exchanged between the first refrigerant passing through the first heat exchanger 130 and the second refrigerant passing through the second heat exchanger 230.

The first heat exchanger 130 is provided at the outlet side of the refrigerating-compartment expansion device 120. The first evaporator 140 may be provided at the outlet side of the first heat exchanger 130. The temperature of the first refrigerant decompressed by the refrigerating-compartment expansion device 120 may be less than that of the second refrigerant flowing in the second heat exchanger 230.

Accordingly, the first refrigerant may absorb heat from the second heat exchanger 230 while passing through the first heat exchanger 130. In this process, the first refrigerant may be evaporated. Accordingly, the first heat exchanger 130 may be referred to as an "auxiliary evaporator".

The second heat exchanger 230 may be provided at the outlet side of the freezing-compartment expansion device 220. The second expansion device 240 may be provided at the outlet side of the second heat exchanger 230. The second refrigerant decompressed by the freezing-compartment expansion device 220 may pass through the second heat exchanger 230 to radiate heat toward the first heat exchanger 130. In this process, the second refrigerant may be supercooled. Accordingly, the second heat exchanger 230 may be referred to as an "auxiliary condenser".

The first and second heat exchangers 130 and 230 may be provided adjacent to each other to perform heat exchange. More specifically, the first and second heat exchangers 130 and 230 may exchange heat using a conduction method according to mutual contact. For example, as shown in FIG. 3, the first and second heat exchangers 130 and 230 may contact each other. The outer circumferential surface of the refrigerant pipe 135 of the first heat exchanger 130 and the outer circumferential surface of the refrigerant pipe 235 of the second heat exchanger 230 may be soldered.

The diameter of the first refrigerant pipe 135 of the first heat exchanger 130 may be greater than the refrigerant pipe 235 of the second heat exchanger 230. More specifically, the refrigerant of the first refrigerant pipe 135 may be evaporated by heat exchange and the refrigerant of the second refrigerant pipe 235 is condensed. The volume of gaseous refrigerant is greater than that of liquefied refrigerant. When the diameter of the pipe in which the gaseous refrigerant flows is too small, drop of the pressure of the gaseous refrigerant increases and thus heat exchange efficiency may deteriorate. Accordingly, by increasing the diameter of the first refrigerant pipe 135 to be greater than that of the second refrigerant pipe 235, it is possible to improve heat exchange efficiency of the intermediate heat exchange unit 330.

As shown in FIGS. 2 and 3, the first refrigerant flowing in the first heat exchanger 130 may flow in a direction opposite to the direction of the second refrigerant flowing in the second heat exchanger 230. More specifically, some of the second refrigerant of the second refrigerant pipe 235 is condensed while heat is delivered to the first refrigerant of the first refrigerant pipe 135. When the refrigerant flow directions of the first and second refrigerant pipes 135 and 235 are opposite to each other, the amount of condensed second refrigerant gradually increases toward the downstream side of the second refrigerant pipe 235, thereby improving heat exchange efficiency.

The second expansion device 240 is provided at the outlet side of the second heat exchanger 230 to decompress the refrigerant supercooled by the second heat exchanger 230. The refrigerant decompressed by the second heat exchanger 230 may be evaporated by the second evaporator 250. The first evaporator 140 is provided at the outlet side of the first heat exchanger 130 and the refrigerant evaporated by the first heat exchanger 130 may be additionally evaporated by the first evaporator 140.

The refrigerating-compartment cycle 10 further includes a first suction pipe 145 extending from the outlet side of the first evaporator 140 to the first compressor 100. The first suction pipe 145 may exchange heat with the refrigerating-compartment expansion device 120. For example, the first suction pipe 145 and the refrigerating-compartment expansion device 120 may be coupled to each other through soldering to perform heat exchange using the conduction method. The first suction pipe 145 and the refrigerating-compartment expansion device 120 form a first suction line heat exchange unit 160.

Low-temperature refrigerant flowing in the first suction pipe 145 and relatively-high-temperature refrigerant passing through the refrigerating-compartment expansion device 120 exchange heat with each other, thereby increasing refrigerant overheating degree of the first suction pipe 145 and increasing the refrigerant supercooling degree of the refrigerating-compartment expansion device 120. As a result, it is possible to improve operational efficiency of the refrigerating-compartment cycle 10.

The freezing-compartment cycle 20 further includes a second suction pipe 255 extending from the outlet side of the second evaporator 250 to the second compressor 200. The second suction pipe 255 may exchange heat with the first and second expansion devices 220 and 240. For example, the second suction pipe 255 and the first and second expansion devices 220 and 240 may be coupled to each other through soldering to perform heat exchange using the conduction method. The second suction pipe 255 and the first and second expansion devices 220 and 240 form a second suction line heat exchange unit 260.

Low-temperature refrigerant flowing in the second suction pipe 255 and relatively-high-temperature refrigerant passing through the first and second expansion devices 220 and 240 exchange heat with each other, thereby increasing refrigerant overheating degree of the second suction pipe 255 and increasing the refrigerant supercooling degree of the first and second expansion devices 220 and 240. As a result, it is possible to improve operational efficiency of the freezing-compartment cycle 20.

The flow of the refrigerant will be briefly described. First, the refrigerant is compressed by the first compressor 100 and the compressed refrigerant is condensed by the first condenser 110. The condensed refrigerant is guided to the first heat exchanger 130 after passing through the refrigerating-compartment expansion device 120. At this time, the refrigerating compartment expansion device 120 is soldered to the first suction pipe 145 connecting the first evaporator 140 to the first compressor 110 in the first suction line heat exchange unit 160 to exchange heat with each other, as shown in FIG. 5.

The first heat exchanger 130 functions as an evaporator while exchanging heat with the second heat exchanger 230 in the intermediate heat exchange unit 330 and the refrigerant in the first heat exchanger 130 may be vaporized. The refrigerant may cool ambient air while passing through the first evaporator 140 to supply cool air to the refrigerating compartment 12.

The refrigerant passing through the first evaporator 140 may be sucked into and compressed by the first compressor 100 through the first suction pipe 145.

In some implementations, the refrigerant compressed by the second compressor 200 is guided into the second condenser 210. The refrigerant is guided to the first expansion device 220 after passing through the second condenser 210 and the first expansion device 220 exchanges heat with the second suction pipe 255 connecting the first evaporator 250 to the second compressor 220 in the second suction line heat exchange unit 260.

The refrigerant passing through the first expansion device 220 may flow into the second heat exchanger 230 and exchange heat with the first heat exchanger 130. In this process, the refrigerant of the second heat exchanger 230 may be condensed.

Here, the condensation capacity of the refrigerant additionally condensed in the second heat exchanger 230 may correspond to a part "A" of FIG. 6. By the part "A", the load of the cooling cycle of the second compressor 200 is shifted to the cooling cycle of the first compressor 100, thereby improving operational efficiency of the refrigerator. That is, since the refrigerant compressed by the second compressor 200 is additionally condensed in the part "A", more cool air may be generated in the second evaporator 250.

The refrigerant passing through the second heat exchanger 230 is guided to the second evaporator 250 after passing through the second expansion device 240. At this time, the second expansion device 240 exchanges heat with the second suction pipe 255 in the second suction line heat exchange unit 260.

The second evaporator 250 may exchange heat with ambient air passing therethrough to generate cool air and to supply the generated cool air to the freezing compartment. The refrigerant passing through the second evaporator 250 may be sucked into and compressed by the second compressor 200 through the second suction pipe 255.

The intermediate exchange unit 330 including the first heat exchanger 130 and the second heat exchanger 230 may be provided at the rear side of the first evaporator 140. More specifically, the intermediate heat exchanger unit 330 is manufactured in a refrigerant pipe structure shown in FIG. 5 and is provided between the outer case 15 and the refrigerating-compartment inner case 16, the ends of the refrigerant pipes are connected to the other refrigerant pipes and then the refrigerant pipes are embedded by injecting an insulation material. The intermediate heat exchanger unit 330 is embedded in the insulation material such that heat exchange between the two refrigerant pipes is possible but heat exchange with ambient air is impossible.

If the intermediate heat exchange unit 330 is provided behind the second evaporator 250, the second evaporator 250 is used to supply cool air to the freezing compartment and, at this time, the intermediate heat exchange unit 330 may function as a load of the freezing compartment. Accordingly, the intermediate heat exchange unit 330 is preferably provided behind the first evaporator 140.

As compared to a refrigerator without the intermediate heat exchange unit 330, cooling efficiency of the refrigerator can be improved.

Figure 7:
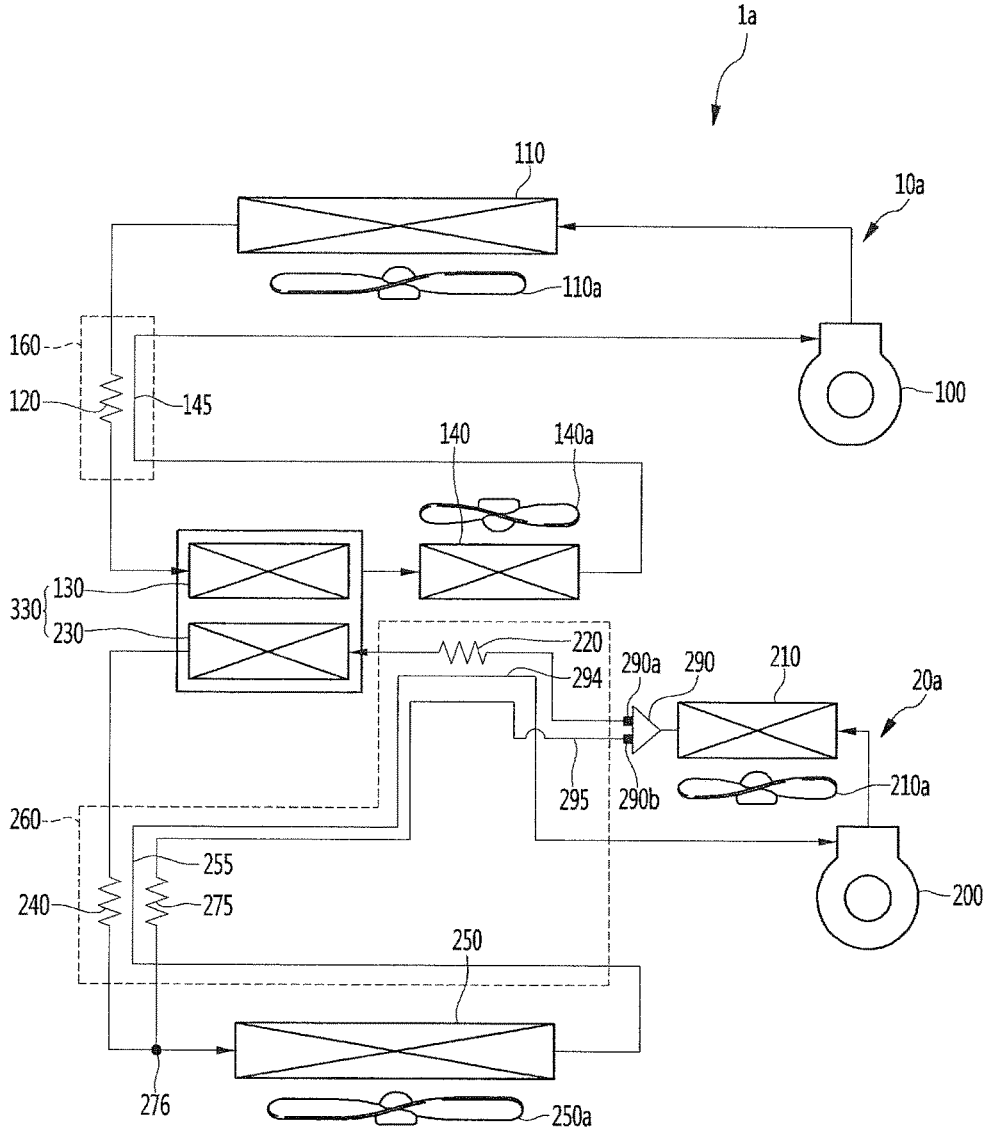
FIG. 7 is a diagram illustrating an example refrigeration cycle of a refrigerator.
Figure 8:
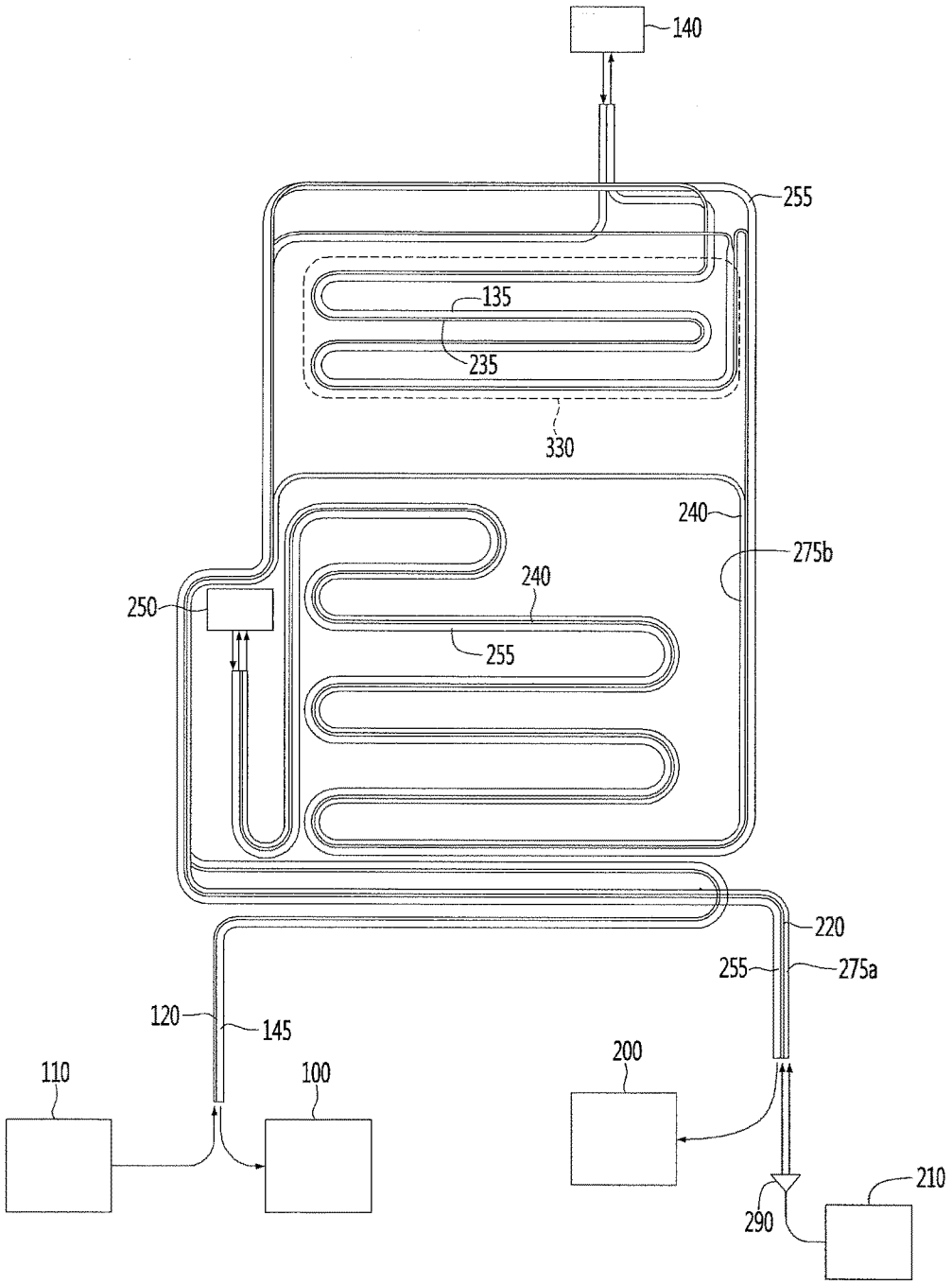
FIG. 8 is a diagram illustrating an example refrigerator.

FIG. 7 illustrates an example refrigeration cycle of a refrigerator. FIG. 8 illustrates an example refrigerator. Referring to FIGS. 7 and 8, the refrigerator 1*a* includes a refrigerating-compartment cycle 10*a* and a freezing-compartment cycle 20*a*.

The refrigerating-compartment cycle 10*a* further includes a valve device 290 provided at the outlet side of the second condenser 210 to control the flow of refrigerant such that the refrigerant passing through the second condenser 210 selectively flows into the second heat exchanger 230. For example, the valve device 290 may include a three-way valve having one inlet and two outlets.

The freezing-compartment cycle 20*a* includes a first flow channel 294 extending from the first inlet 290*a* of the valve device 290 to the second heat exchanger 230 and a second flow channel 295 extending from the second outlet 290*b* of the valve device 290 to a coupler 276 of the first flow channel 294. According to the control state of the valve device 290, the refrigerant may flow through at least one of the first and second flow channels 294 and 295.

When the valve device 290 is controlled such that the first flow channel 294 is opened and the second flow channel 295 is closed, the refrigerant flows into the second heat exchanger 230 to perform heat exchange in the intermediate heat exchange unit 330. That is, the load of the freezing-compartment cycle 20*a* is shifted to the refrigerating-compartment cycle 10*a*, thereby obtaining supercooling effect of the refrigerating-compartment cycle 10*a*. The load of the refrigerating compartment is less than that of the freezing compartment and the operational efficiency of the refrigerating-compartment cycle 10*a* is higher than that of the freezing-compartment cycle 20*a*, thereby improving the operation performance of the refrigerator.

In some implementations, when the valve device 290 is controlled such that the second flow channel 295 is opened and the first flow channel 294 is closed, the refrigerant may bypass the second heat exchanger 230 and flow toward the inlet side of the second evaporator 250. That is, the shift of the load of the refrigerating-compartment cycle 10*a* to the freezing-compartment cycle 20*a* is restricted, thereby improving the cooling speed of the refrigerating compartment 12.

In the first flow channel 294, the first expansion device 220, the second heat exchanger 230 and the second expansion device 240 may be provided. Accordingly, the refrigerant flowing in the first flow channel 294 may flow into the second evaporator 250 through the first expansion device 220, the second heat exchanger 230 and the second expansion device 240.

In the second flow channel 295, a third expansion device 275 may be provided. The third expansion device 275 may be understood as a refrigerating-compartment expansion device. For example, the third expansion device 275 may include a capillary tube. Accordingly, the refrigerant flowing in the second flow channel 295 may flow into the second evaporator 250 through the third expansion device 275 and the coupler 276. The coupler 276 is a point where the first flow channel 294 and the second flow channel 295 meet and may be provided at the inlet side of the second evaporator 250.

The length or diameter of the refrigerating-compartment expansion device 120 may be determined such that the decompression level of the refrigerating-compartment expansion device 120 is greater than that of the first expansion device 220. For example, the diameter of the refrigerating-compartment expansion device 120 may be less than that of the first expansion device 220. The length of the refrigerating-compartment expansion device 120 may be greater than that of the first expansion device 220.

The diameter of the third expansion device 275 may be greater than that of the first expansion device 220 or the second expansion device 240. For example, the diameter of the third expansion device 275 may be 0.9 mm and the diameter of the first and second expansion devices 220 and 240 may be 0.7 mm.

Accordingly, the flow resistivity of the refrigerant passing through the second flow channel 295 may be less than that of the refrigerant passing through the first flow channel 294. As a result, the amount of refrigerant flowing when the second flow channel 295 is opened may be greater than that of refrigerant flowing when the first flow channel 294 is opened.

The valve device 290 may be controlled based on a load required for the refrigerator. For example, upon cooling operation or cooling-after-defrosting operation of the refrigerator, that is, if the load of the refrigerator is high, the valve device 290 is controlled to prevent heat exchange in the intermediate heat exchange unit 330. That is, the valve device 290 is controlled such that the first outlet 290*a* is closed and the second outlet 290*b* is opened. Therefore, the refrigerant may flow in the second flow channel.

In this example, the amount of refrigerant flowing into the second evaporator 250 through the second flow channel 295 may increase, and the load of the freezing-compartment cycle 20*a* may not be shifted to the refrigerating-compartment cycle 10*a*, thereby rapidly performing cooling of the refrigerating compartment 12.

In some implementations, if a stable cooling cycle is performed after cooling operation or cooling-after-defrosting operation of the refrigerator, that is, if the load of the refrigerator is low, the valve device 290 is controlled such that heat exchange is performed in the intermediate heat exchange unit 330. That is, the valve device 290 is controlled such that the second outlet 290*b* is closed and the first outlet 290*a* is opened. Thus, the refrigerant may flow in the first flow channel 294.

In this example, the amount of refrigerant flowing into the second evaporator 250 through the first flow channel 294 may be slightly low but the load of the freezing-compartment cycle 20' may be shifted to the refrigerating-compartment cycle 10', thereby improving the supercooling degree of the freezing-compartment cycle 20'.

The second suction pipe 255 may exchange heat with the first to third expansion devices 220, 240 and 275. For example, the second suction pipe 255 and the first to third expansion devices 220, 240 and 275 are coupled to each other through soldering to perform heat exchange according to the conduction method. The second suction pipe 255 and the first to third expansion devices 220, 240 and 275 form a second suction line heat exchange unit 260.

Here, the third expansion device 275 may lengthily extend to be coupled with the first and second expansion devices 220 and 240 and the second suction pipe 255. More specifically, the third expansion device 275 may include a first expansion part 275*a* coupled with the first expansion device 220 and the second suction pipe 255 and a second expansion part 275*b* coupled with the second expansion device 240 and the second suction pipe 255 as illustrated in FIG. 8.

Figure 9:
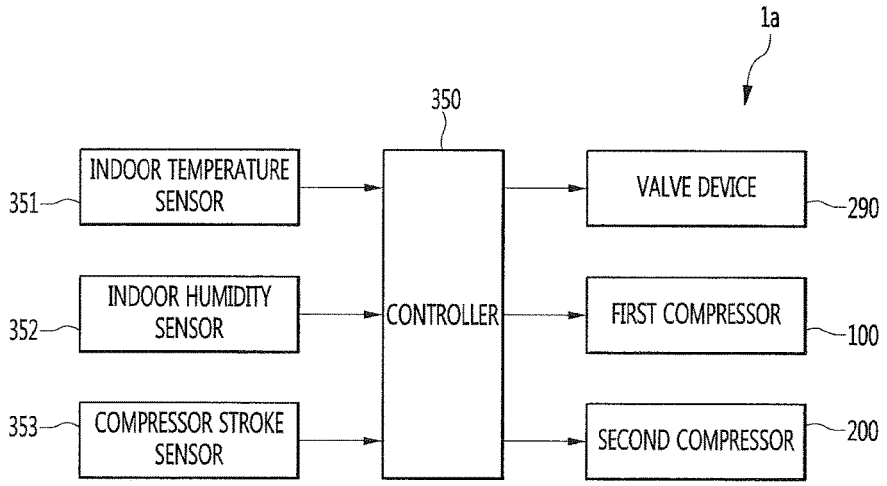
FIG. 9 is a block diagram illustrating an example refrigerator.
Figure 10:
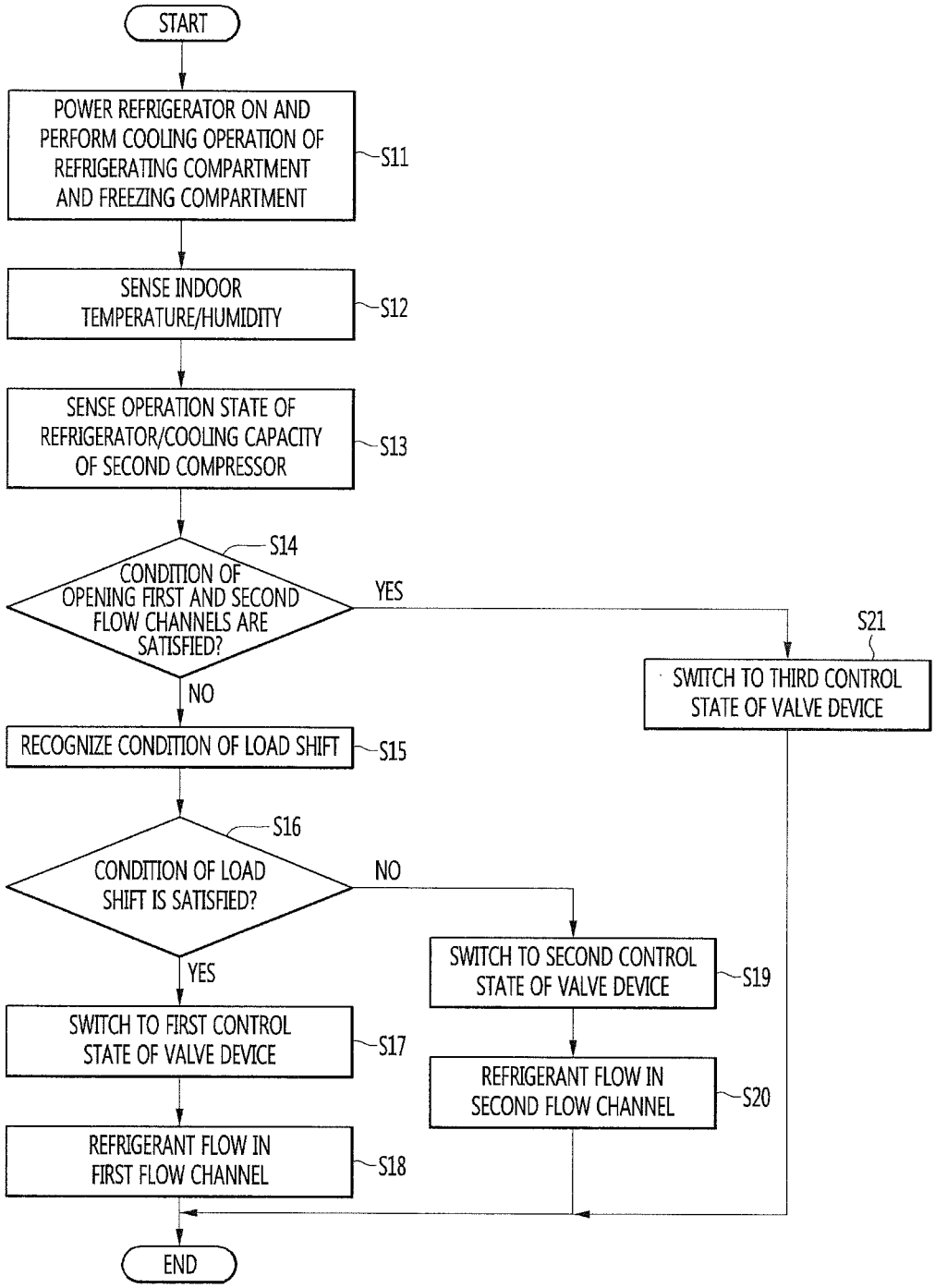
FIG. 10 is a flowchart of an example process for controlling a refrigerator.

FIG. 9 illustrates an example refrigerator. FIG. 10 is a flowchart of an example process for controlling a refrigerator.

Referring to FIG. 9, the refrigerator 1*a* includes an indoor temperature sensor 351 for sensing the temperature of an indoor space where the refrigerator 1*a* is provided, an indoor humidity sensor 352 for sensing the humidity of the indoor space and a compressor stroke sensor 353 for sensing the stroke of the second compressor 200. The compressor stroke sensor 353 senses the stroke of reciprocal motion of a piston of the second compressor 200. The stroke may be used to determine the cooling capacity of the second compressor 200. Accordingly, the compressor stroke sensor 353 is understood as a "cooling capacity sensor".

The refrigerator 1*a* further includes a controller 350 for controlling operation of the first and second compressors 100 and 200 or the valve device 290 based on the temperature information sensed by the indoor temperature sensor 351.

For example, if the indoor temperature sensed by the indoor temperature sensor 351 is equal to or greater than a predetermined temperature or if the refrigerator 1*a* initially operates, the controller 350 may regard the load of the refrigerator 1*a* as being high, increase the operating frequency of the first compressor 100 or the second compressor 200, and increase the cooling capacity (stroke).

The indoor temperature information and the operating frequencies and cooling capacities of the first and second compressors 100 and 200 may be mapped and pre-stored. The operation state of the refrigerator 1, that is, the condition related to the cooling operation, cooling-after-defrosting operation or stabilization operation and the operating frequencies and cooling capacities of the first and second compressors 100 and 200 may be mapped and pre-stored. Here, the "stabilization operation" may be understood as a state in which the pressure ranges of the refrigerating-compartment cycle 10' and the freezing-compartment cycle 20*a* reach a normal range to stably perform operation.

The controller 350 may determine the load of the refrigerator 1*a* based on the cooling capacity sensed by the compressor stroke sensor 353 and adjust the control state of the valve device 290.

Referring to FIG. 10, the refrigerator 1*a* is powered on and the cooling operations of the refrigerating compartment 12 and the freezing compartment 13 may be performed (S11). Then, the temperature or humidity of the indoor space where the refrigerator 1*a* is provided may be sensed (S12).

Along with the operation state of the refrigerator 1*a*, the cooling capacity of the second compressor 200 may be sensed. The cooling capacity of the second compressor 200 may be set to a value previously mapped based on the operation state of the refrigerator 1*a*. For example, if the cooling operation or cooling-after-defrosting operation of the refrigerator 1 is performed, since a relatively high load is required, the cooling capacity of the second compressor 200 may be determined to output first cooling capacity. The first cooling capacity is the highest cooling capacity and may be greater than predetermined cooling capacity.

In some implementations, if the cooling cycle of the refrigerator 1*a* is stabilized, since a relatively low load is required, the cooling capacity of the second compressor 200 may be determined to output second cooling capacity. The second cooling capacity is less than the first cooling capacity and may be less than the predetermined cooling capacity (S13).

Based on the operation state of the refrigerator 1*a* and the cooling capacity of the second compressor 200, the control state of the valve device 290 is determined. The control state of the valve device 290 may include a "first control state" for opening the first flow channel 294 and closing the second flow channel 295, a "second control state" for opening the second flow channel 295 and closing the first flow channel 294 and a "third control state" for opening the first and second flow channels 294 and 295.

Whether the condition of opening the first and second flow channels 294 and 295 is satisfied may be determined. For example, the condition may include the operation state from the start to the end of the defrosting operation after a rapid freezing operation is finished. At this time, the valve device 290 may be controlled to open the first and second outlets 290*a* and 290*b* and the operation of the second compressor 200 may be stopped (S14 and S21).

If the condition of opening the first and second flow channels 294 and 295 is not satisfied, whether the condition of shifting the load from the freezing-compartment cycle 20 to the refrigerating-compartment cycle 10 is satisfied may be determined.

The condition that load shift is not performed may include the case where the second compressor 200 outputs the first cooling capacity, the case where the indoor temperature is relatively low or the case where the indoor humidity is relatively high. If the indoor temperature is relatively low, the density of the refrigerant circulated in the freezing-compartment cycle 20 may increase and thus the amount of gaseous refrigerant sucked into the first compressor 200 may decrease. Accordingly, the load of the refrigerator may increase and thus the amount of circulated refrigerant needs to increase.

If the indoor humidity is relatively high, the load needs to increase in order to prevent dew from being formed in the refrigerator and thus the amount of circulated refrigerant needs to increase.

In some implementations, load shift is not performed and the valve device 290 is switched to the second control state to close the first flow channel 294 and open the second flow channel 295. Accordingly, the refrigerant may bypass the intermediate heat exchange unit 330 to flow toward the inlet side of the second evaporator 250. As a result, since the refrigerant flows in the second flow channel 295 having relatively low flow resistivity, the amount of circulated refrigerant may increase (S16, S19 and S20).

The condition of performing load shift includes conditions other than the condition of opening the first and second flow channels 294 and 295 and the condition that load shift is not performed. In this example, the load of the refrigerator is recognized as being relatively low. Accordingly, the valve device 290 may be switched to the first control state to open the first flow channel 294 and close the second flow channel 295. Accordingly, the refrigerant flows into the intermediate heat exchange unit 330 and exchanges heat with the refrigerating-compartment cycle 10, thereby increasing the supercooling degree (S17 and S18).

According to the control method, by changing the control state of the valve device 290 according to the load of the refrigerator, the refrigerant may bypass the intermediate heat exchange unit 330 and flow in the second flow channel 295 having low flow resistivity if a large amount of refrigerant of the system is necessary, and the refrigerant may be guided to the intermediate heat exchange unit 330 if a large amount of refrigerant of the system is not necessary, thereby improving system performance and reducing power consumption.

Figure 11:
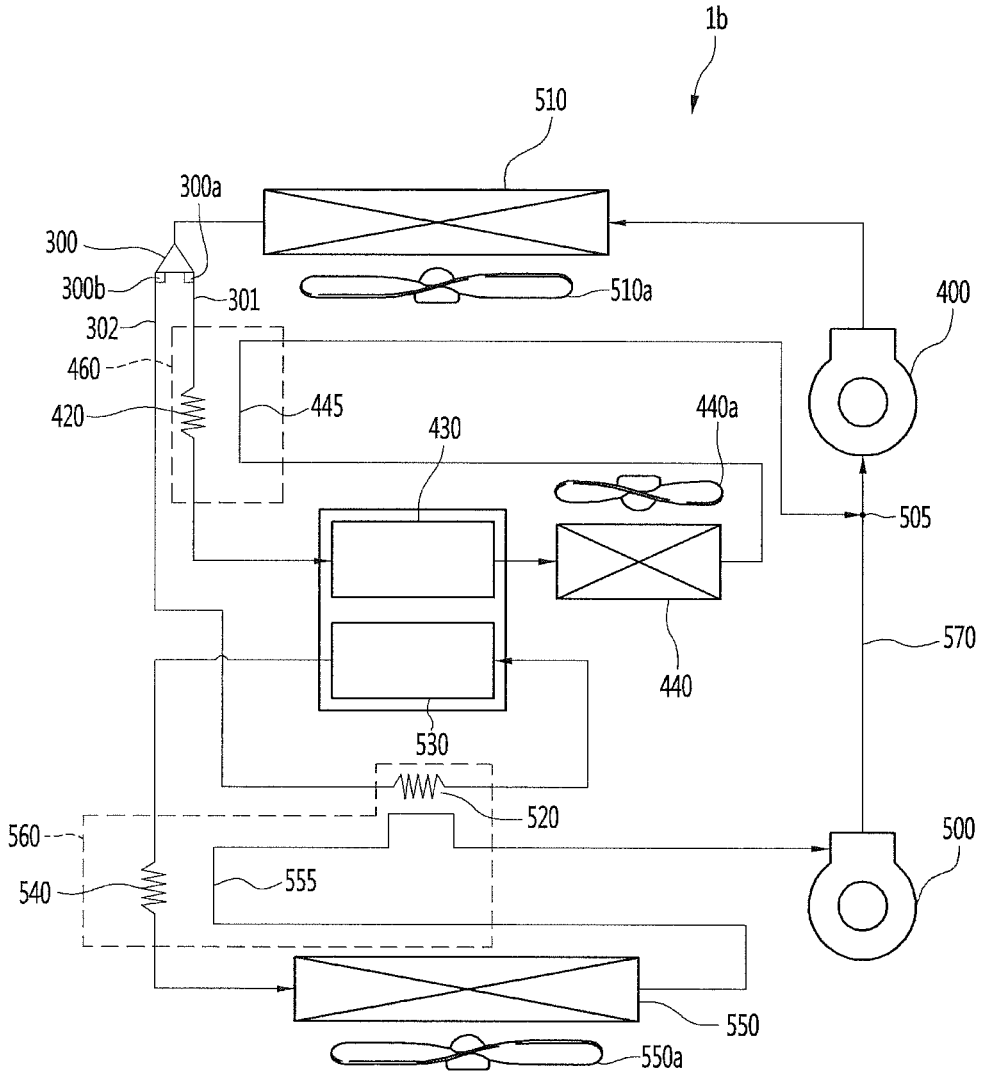
FIG. 11 is a diagram illustrating an example freezing cycle of a refrigerator.
Figure 12:
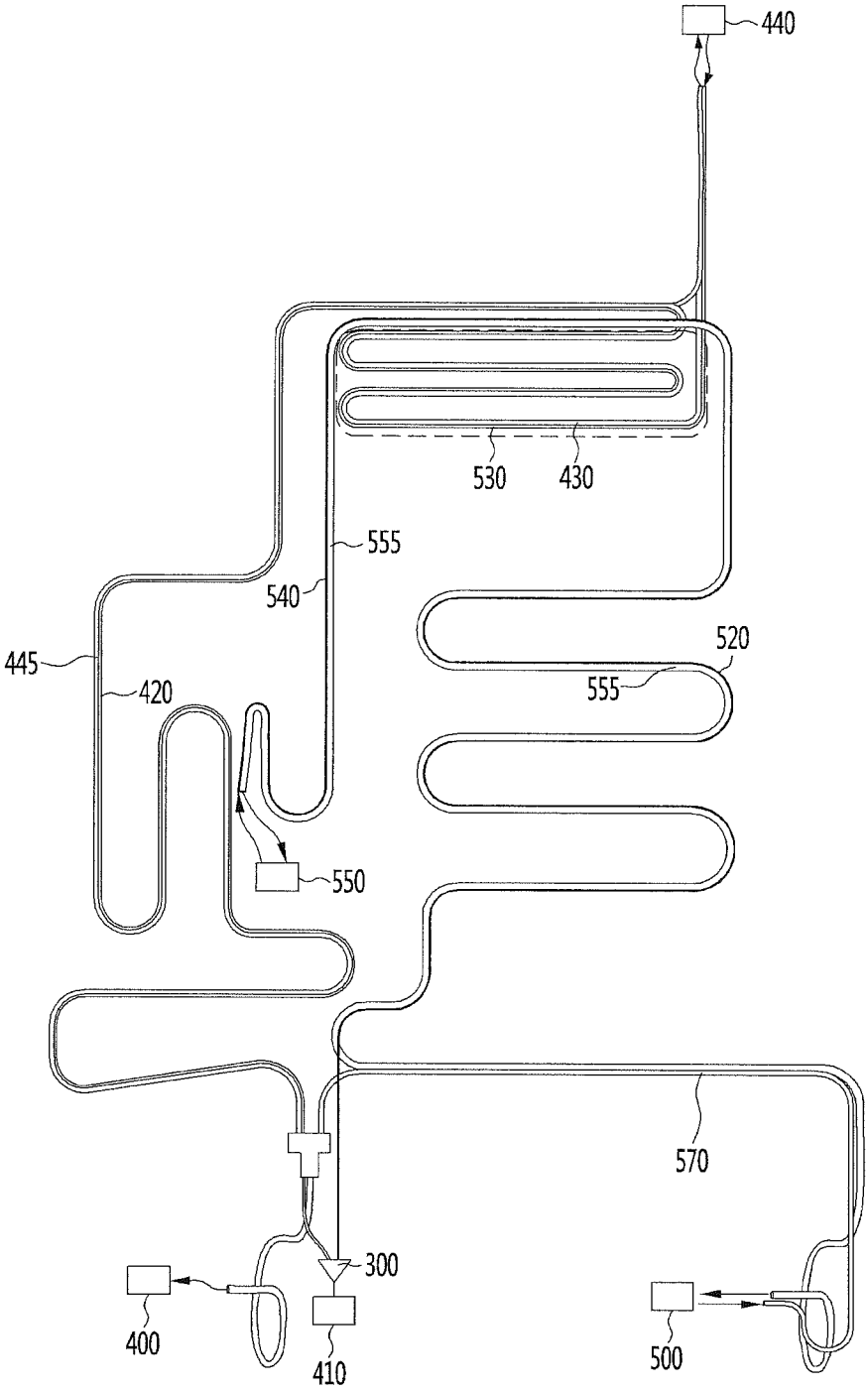
FIG. 12 is a diagram illustrating an example refrigerator.
Figure 13:
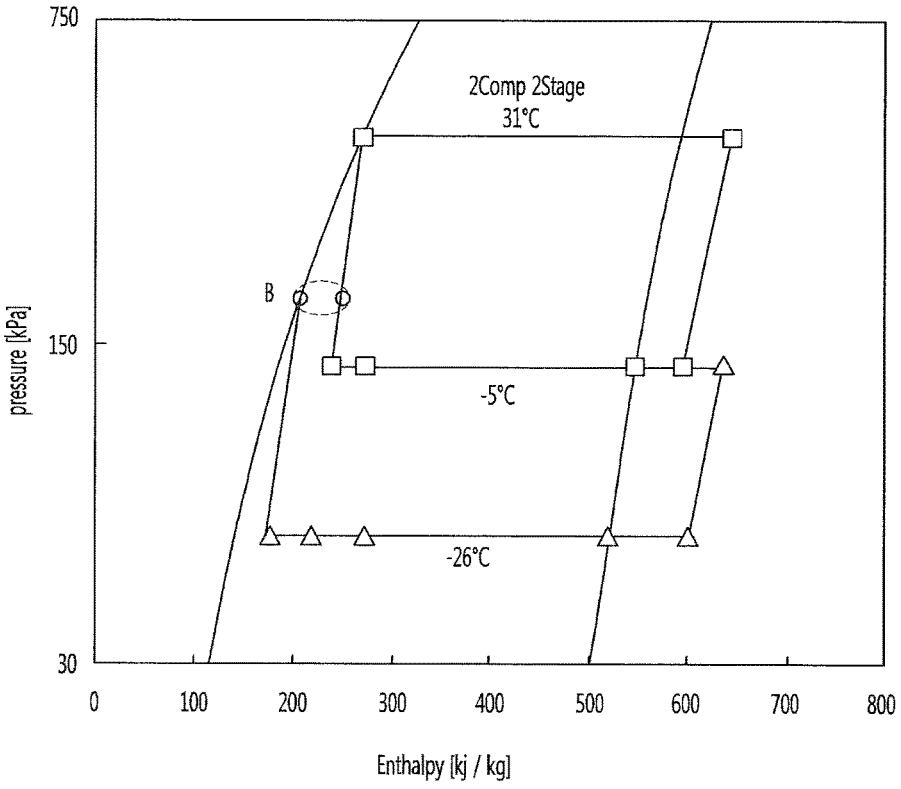
FIG. 13 is a graph illustrating an example P-H curve with reference to FIG. 11.

FIG. 11 illustrates an example freezing cycle of a refrigerator. FIG. 12 illustrates an example refrigerator. FIG. 13 illustrates a graph showing an example P-H curve with reference to FIG. 11.

Referring to FIGS. 11 to 13, the refrigerator 1*b* includes a plurality of devices for driving the freezing cycle.

More specifically, the refrigerator 1*b* includes a plurality of compressors 400 and 500 for compressing refrigerant, a condenser 510 for condensing the refrigerant compressed by the plurality of compressors 400 and 500, a plurality of expansion devices 420, 520 and 540 for decompressing the refrigerant condensed by the condenser 510 and a plurality of evaporators 440 and 550 for evaporating the decompressed refrigerant by the plurality of expansion devices 420, 520 and 540.

The plurality of compressors 400 and 500 includes the first compressor 400 and the second compressor 500. The second compressor 500 is a "low-pressure compressor" provided at a low pressure side to first-stage compress the refrigerant and the first compressor 400 is a "high-pressure compressor" for further compressing (second-stage compressing) the refrigerant compressed by the second compressor 500. The second compressor 500 may be understood as a freezing-compartment cooling compressor and the second compressor 400 may be understood as a refrigerating-compartment cooling compressor.

The plurality of evaporators 440 and 550 includes the first evaporator 440 for generating cool air to be supplied to the refrigerating compartment and the second evaporator 550 for generating cool air to be supplied to the freezing compartment. The refrigerator 1*b* may further include a condensation fan 510*a* provided at one side of the condenser 510 and first and second evaporation fans 440*a* and 550*a* provided at one sides of the first and second evaporators 440 and 550.

The refrigerator 1*b* further includes a second suction pipe 555 extending from the outlet side of the second evaporator 550 to the inlet side of the second compressor 500. Accordingly, the refrigerant passing through the second evaporator 550 may be sucked into the second compressor 500.

The refrigerator 1*b* further includes a first suction pipe 445 extending from the outlet side of the first evaporator 440 to the inlet side of the first compressor 400 and a coupler 505 where the first suction pipe 445 and the outlet-side refrigerant pipe, that is, a low-pressure discharge pipe 570, of the second compressor 500 are coupled. Accordingly, the first-stage compressed refrigerant flowing the low-pressure discharge pipe 570 is coupled with the refrigerant passing through the first evaporator 440 in the coupler 505 and is sucked into the first compressor 400. The refrigerant sucked into the first compressor 400 flows into the condenser 510 after being compressed.

The plurality of expansion devices 420, 520 and 540 includes a refrigerating-compartment expansion device 420 for expanding the refrigerant which will flow into the first evaporator 440. The refrigerator 1*b* further includes a first heat exchanger 430 provided at the outlet side of the refrigerating-compartment expansion device 420. The first evaporator 440 may be provided at the outlet side of the first heat exchanger 430. The first heat exchanger 430 forms an intermediate heat exchange unit along with the second heat exchanger 530 and absorbs heat from the heat exchanger 530 to guide evaporation of the refrigerant.

The first suction pipe 445 and the refrigerating-compartment expansion device 420 may exchange heat with each other. For example, the first suction pipe 445 and the refrigerating-compartment expansion device 420 may be coupled to each other through soldering. By heat exchange, the supercooling degree of the refrigerant flowing in the refrigerating-compartment expansion device 420 and the overheating degree of the refrigerant flowing in the first suction pipe 445 can be improved. The first suction pipe 445 and the refrigerating-compartment expansion device 420 form a first suction line heat exchange unit 460.

The plurality of expansion devices 420, 520 and 540 further includes the first expansion device 520 and the second expansion device 540. The refrigerator 1*b* further includes a second heat exchanger 530 provided between the first and second expansion devices 520 and 540. The refrigerant decompressed by the first expansion device 520 may be cooled by the second heat exchanger 530 and may be decompressed by the second expansion device 540 again. Then, the refrigerant decompressed by the second expansion device 540 may flow into the second evaporator 550.

The second heat exchanger 530 may form the intermediate heat exchange unit along with the first heat exchanger 430 and radiate heat to the second heat exchanger 530 to guide supercooling of the refrigerant.

The second suction pipe 555 and the freezing-compartment expansion devices 520 and 540 may exchange heat with each other. For example, the second suction pipe 555 and the freezing-compartment expansion devices 520 and 540 may be coupled to each other through soldering. By heat exchange, the supercooling degree of the refrigerant flowing in the freezing-compartment expansion devices 520 and 540 and the overheating degree of the refrigerant flowing in the second suction pipe 555 can be improved. The second suction pipe 555 and the freezing-compartment expansion devices 520 and 540 form a second suction line heat exchange unit 560.

The refrigerator 1*b* further includes a valve device 300 provided at the outlet side of the condenser 510 to control the flow of the refrigerant such that the refrigerant passing through the condenser 510 selectively flows into the first and second evaporators 440 and 550. For example, the valve device 300 includes a three-way valve having one inlet and two outlets.

The refrigerator 1*b* includes a first flow channel 301 extending from the first outlet 300*a* of the valve device 300 to the first heat exchanger 430 and a second flow channel 302 extending from the second outlet 300*b* of the valve device 300 to the second heat exchanger 530. According to the control state of the valve device 600, the refrigerant may flow through at least one of the first and second flow channels 301 and 302.

The refrigerant branched to the first flow channel 301 by the valve device 300 is guided to the first heat exchanger after passing through the refrigerating-compartment expansion device 420. The refrigerant absorbs external heat while primarily evaporating in the first heat exchanger 430 and further evaporates after passing through the first evaporator 440, thereby supplying cool air to the refrigerating compartment. The refrigerant passing through the first evaporator 440 may be sucked into and compressed by the first compressor 400 through the first suction pipe 445.

The refrigerant branched to the second flow channel 302 by the valve device 300 is guided to the first expansion device 520 and the first expansion device 520 exchanges heat with the second suction pipe 555 in the second suction line heat exchange unit 460.

The refrigerant passing through the first expansion device 520 flows into the second heat exchanger 530 and the second heat exchanger 530 exchanges heat with the first heat exchanger 430. In this process, some of the refrigerant of the second heat exchanger 530 may be condensed while radiating heat. That is, as shown in FIG. 13, the refrigerant may be further condensed in a part "B" while passing through the second heat exchanger 530. Since the load may be shifted upon cooling while the refrigerant passes through the part "B", operational efficiency of the refrigerator can be improved.

The refrigerant passing through the second heat exchanger 530 is guided to the second evaporator 550 for supplying cool air to the freezing compartment after passing through the second expansion device 540. At this time, the second expansion device 540 exchanges heat with the second suction pipe 555. The second evaporator 550 may exchange heat with ambient air passing therethrough to generate cool air and the generated cool air may be supplied to the freezing compartment. The refrigerant passing through the second evaporator 550 may be sucked into and compressed by the second compressor 500 through the second suction pipe 555.

Figure 14:
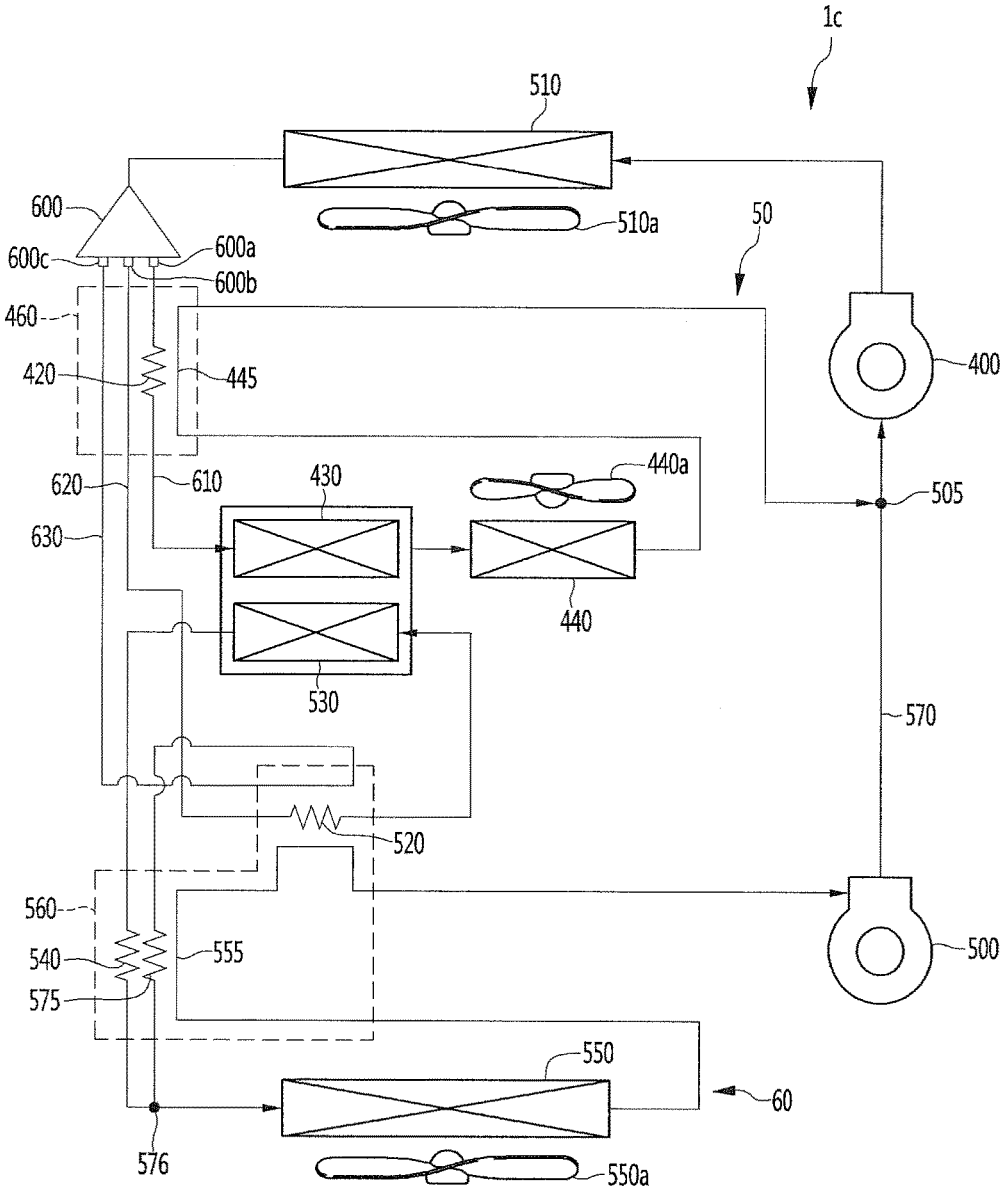
FIG. 14 is a diagram illustrating an example freezing cycle of a refrigerator.

FIG. 14 illustrates an example freezing cycle of a refrigerator. Referring to FIG. 14, the refrigerator 1*c* includes a plurality of compressors 400 and 500 for compressing refrigerant, a condenser 510 for condensing the refrigerant compressed by the plurality of compressors 400 and 500, a plurality of expansion devices 420, 520, 540 and 575 for decompressing the refrigerant condensed by the condenser 510 and a plurality of evaporators 440 and 550 for evaporating the decompressed refrigerant by the plurality of expansion devices 420, 520, 540 and 575.

The plurality of expansion devices 420, 520, 540 and 575 includes the refrigerating-compartment expansion device 420 for expanding the refrigerant flowing into the first evaporator 440, the first expansion device 530 and the second expansion device 540. The plurality of expansion devices 420, 520, 540 and 575 further includes the third expansion device 575. The third expansion device 575 configures a freezing-compartment expansion device along with the first and second expansion devices 520 and 540.

The refrigerator 1*c* further includes a valve device 600 provided at the outlet side of the condenser 510 to control the flow of the refrigerant such that the refrigerant passing through the condenser 510 selectively flows into the first and second evaporators 440 and 550. For example, the valve device 600 includes a four-way valve having one inlet and three outlets. The valve device 600 may control the flow of the refrigerant such that the refrigerant selectively flows into the second heat exchanger 530.

The refrigerator 1*c* includes a first flow channel 601 extending from the first outlet 600*a* of the valve device 600 to the first heat exchanger 430, a second flow channel 602 extending from the second outlet 600*b* of the valve device 600 to the second heat exchanger 530, and a third flow channel 630 extending from the third outlet 600*c* of the valve device 600 to the coupler 576. According to the control state of the valve device 600, the refrigerant may flow through at least one of the first to third flow channels 610, 620 and 630.

When the valve device 600 is controlled such that the first and second flow channels 610 and 620 are opened and the third flow channel 630 is closed, the refrigerant may flow into the first and second heat exchangers 430 and 530 to perform heat exchange in the intermediate heat exchanger unit 330. That is, the load of the freezing-compartment cycle 60 is shifted to the refrigerating-compartment cycle 50, thereby obtaining supercooling effect of the refrigerating-compartment cycle 50.

In some implementations, when the valve device 600 is controlled such that the first and third flow channels 610 and 630 are opened and the second flow channel 620 is closed, some of the refrigerant may flow into the first heat exchanger 430 but the remaining refrigerant may bypass the second heat exchanger 530 and flow toward the inlet side of the second evaporator 250. That is, the shift of the load of the freezing-compartment cycle 60 to the refrigerating-compartment cycle 20*a* is restricted, thereby improving the cooling speed of the refrigerating compartment 12.

If cooling of the refrigerating compartment 12 is not necessary, the first flow channel 610 may be closed and the third flow channel may be opened, thereby operating only the freezing-compartment cycle 60. Of course, at this time, heat exchange in the intermediate heat exchange units 430 and 530 may be restricted.

In the first flow channel 610, the refrigerating-compartment expansion device 420 may be provided. Accordingly, the refrigerant flowing in the first flow channel 610 may flow into the first evaporator 440 through the refrigerating-compartment expansion device 420 and the first heat exchanger 430.

In the second flow channel 620, the first and second expansion devices 520 and 540 may be provided. Accordingly, the refrigerant flowing in the second flow channel 620 may flow into the second evaporator 250 through the first expansion device 520, the second heat exchanger 530 and the second expansion device 540.

In the third flow channel, the third expansion device 575 may be provided.

The three outlets of the valve device 600 may include the first outlet 600*a* connected to the first flow channel 610, the second outlet 600*b* connected to the second flow channel 620 and the third outlet 600*c* connected to the third flow channel 630. The valve device 600 may be controlled to open at least one of the three outlets. The third flow channel 630 extends from the third outlet 600*c* to the coupler 576. The coupler 576 is a point where the second and third flow channels 620 and 630 meet and may be provided at the inlet side of the second evaporator 250.

Each of the refrigerating-compartment expansion device 420 and the first to third expansion devices 520, 540 and 575 may include a capillary tube.

The diameter of the third expansion device 575 may be greater than that of the first expansion device 520 or the second expansion device 540. For example, the diameter of the third expansion device 575 may be 0.9 mm and the diameter of the first and second expansion devices 520 and 540 may be 0.7 mm.

Accordingly, the flow resistivity of the refrigerant passing through the third flow channel 630 may be less than that of the refrigerant passing through the second flow channel 620. As a result, the amount of refrigerant flowing when the third flow channel 630 is opened may be greater than that of refrigerant flowing when the second flow channel 620 is opened.

Accordingly, in the refrigerator, to which a cooling system using two-stage compression is applied, the control state of the valve device 600 can be changed according to the load of the refrigerator. More specifically, if the load of the refrigerator is high and thus refrigerant flows in the third flow channel 630, heat exchange in the intermediate heat exchange units 430 and 530 is not performed and the amount of refrigerant flowing into the second evaporator 550 through the third flow channel 630 may increase. As a result, since the load of the freezing-compartment cycle 60 is not shifted to the refrigerating-compartment cycle 50, it is possible to rapidly perform cooling of the refrigerating compartment.

In some implementations, if the load of the refrigerator is low and thus the refrigerant flows into the second flow channel 250, the amount of refrigerant flowing into the second evaporator 250 may slightly decrease but the load of the load of the freezing-compartment cycle 60 is shifted to the refrigerating-compartment cycle 50, thereby improving the supercooling degree of the freezing-compartment cycle 60.

The second suction pipe 555 and the freezing-compartment expansion devices 520, 540 and 575 may exchange heat with each other. The second suction pipe 555 and the freezing-compartment expansion devices 520, 540 and 575 may be coupled to each other through soldering. By heat exchange, the supercooling degree of the refrigerant flowing in the freezing-compartment expansion devices 520, 540 and 575 and the overheating degree of the refrigerant flowing in the second suction pipe 555 can be improved.

The second suction pipe 555 and the freezing-compartment expansion devices 520, 540 and 575 form a second suction line heat exchange unit 560.

What is claimed is:

1. A refrigerator comprising:

a compressor configured to compress a refrigerant:

a condenser configured to condense the refrigerant;

a first evaporator that is configured to evaporate the refrigerant condensed by the condenser, the evaporated refrigerant being configured to cool a refrigerating compartment;

a second evaporator that is configured to evaporate the refrigerant condensed by the condenser, the evaporated refrigerant being configured to cool a freezing compartment;

a first heat exchanger coupled to the first evaporator;

a refrigerating-compartment expansion device that is coupled to the first heat exchanger and that is configured to expand the refrigerant and provide the expanded refrigerant to the first heat exchanger;

a second heat exchanger coupled to the second evaporator; and a freezing-compartment expansion device that is coupled to the second heat exchanger and that includes (i) a first expansion device coupled to an inlet side of the second heat exchanger and (ii) a second expansion device coupled to an outlet side of the second heat exchanger, wherein the compressor includes (i) a first compressor that is configured to compress the refrigerant evaporated by the first evaporator and (ii) a second compressor that is configured to compress the refrigerant evaporated by the second evaporator, wherein the refrigerant expanded by the refrigerating-compartment expansion device passes through the first heat exchanger, the refrigerant expanded by the first expansion device of the freezing-compartment expansion device passes through the second heat exchanger, and the first heat exchanger is configured to cool the second heat exchanger, and wherein (i) the refrigerant passing through the first heat exchanger flows into the first evaporator and (ii) the refrigerant passing through the second heat exchanger is expanded by the second expansion device of the freezing-compartment expansion device and flows into the second evaporator.

2. The refrigerator of claim 1, further comprising:

a suction pipe that is configured to couple the second evaporator to the compressor, wherein the first expansion device, the second expansion device, and the suction pipe exchange heat with each other.

3. The refrigerator of claim 1, wherein a first surface of the first heat exchanger and a first surface of the second heat exchanger are coupled together.

4. The refrigerator of claim 1, further comprising:

a valve device that couples the condenser to the second heat exchanger and that is configured to control an amount of the refrigerant provided from the condenser to the second heat exchanger.

5. The refrigerator of claim 4, wherein the first expansion device is coupled to a first outlet side of the valve device and is configured to expand the refrigerant that is provided to the second heat exchanger, and wherein the second expansion device is coupled to an outlet side of the second heat exchanger and is configured to expand the refrigerant that is output from the second heat exchanger.

6. The refrigerator of claim 5, further comprising:

a third expansion device that is coupled to a second outlet side of the valve device and that is configured to expand the refrigerant that bypasses the second heat exchanger.

7. The refrigerator of claim 6, wherein each of the first expansion device, the second expansion device, and the third expansion devices includes a respective capillary tube, and wherein a diameter of the capillary tube of the third expansion device is greater than a diameter of the capillary tube of the first expansion device or a diameter of the capillary tube of the second expansion device.

8. The refrigerator of claim 6, wherein the valve device includes a first valve including a first inlet, a first outlet, and a second outlet, and wherein the first valve is coupled to:

a first flow channel that extends from the first outlet of the first valve and that is coupled to the first expansion device, the second expansion device, and the second heat exchanger; and a second flow channel that extends from the second outlet of the first valve and that is coupled to the third expansion device.

9. The refrigerator of claim 8, further comprising:

a coupler that couples the first flow channel to the second flow channel, wherein the coupler is coupled to an inlet side of the second evaporator.

10. The refrigerator of claim 1, further comprising a second valve that includes a first inlet, a first outlet, a second outlet, and a third outlet, wherein the second valve is coupled to:

a first flow channel that extends from the first outlet of the second valve to the first heat exchanger;

a second flow channel that extends from the second outlet of the second valve to the second heat exchanger; and a third flow channel that extends from the third outlet of the second valve to the second evaporator.

11. The refrigerator of claim 10, further comprising:

a refrigerating-compartment expansion device that is provided in the first flow channel and that is coupled to the first heat exchanger;

a first expansion device that is provided in the second flow channel and that is coupled to the second heat exchanger; and a second expansion device that is provided in the second flow channel and that is coupled to the second heat exchanger.

12. The refrigerator of claim 11, further comprising:

a third expansion device provided in the third flow channel.

13. A method of controlling a refrigerator including (i) a first compressor, a first condenser, a first heat exchanger, and a first evaporator for a refrigerating-compartment cycle and (ii) a second compressor, a second condenser, a second heat exchanger, a freezing-compartment expansion device, and a second evaporator for a freezing-compartment cycle, wherein the first heat exchanger is configured to cool the second heat exchanger, the method comprising:

sensing a temperature of an indoor space of the refrigerator;

sensing cooling capacity of the second compressor; and controlling an amount of a refrigerant provided to the second heat exchanger based on the temperature of the indoor space or the cooling capacity of the second compressor.

14. The method of claim 13, further comprising:

determining that the cooling capacity of the second compressor satisfies a threshold cooling capacity;

providing the refrigerant to the second heat exchanger based on the determination that the cooling capacity of the second compressor satisfies the threshold cooling capacity; and providing the refrigerant to the second evaporator based on the determination that the cooling capacity of the second compressor satisfies the threshold cooling capacity.

15. The method of claim 14, further comprising:

decompressing the refrigerant that is provided to the second heat exchanger; and decompressing the refrigerant that is provided to the second evaporator.

16. The method of claim 15, further comprising:

exchanging heat among (i) a suction pipe that extends from the second evaporator to the second compressor and (ii) one or more expansion devices of the freezing-compartment expansion device.

17. The method of claim 14, further comprising:

providing the refrigerant into two different channels using a three-way valve.

18. A refrigerator comprising:

a compressor configured to compress a refrigerant;

a condenser configured to condense the refrigerant;

a first evaporator that is configured to evaporate the refrigerant condensed by the condenser, the evaporated refrigerant being configured to cool a refrigerating compartment;

a second evaporator that is configured to evaporate the refrigerant condensed by the condenser, the evaporated refrigerant being configured to cool a freezing compartment;

a first heat exchanger coupled to the first evaporator;

a refrigerating-compartment expansion device that is coupled to the first heat exchanger and that is configured to expand the refrigerant and provide the expanded refrigerant to the first heat exchanger;

a second heat exchanger coupled to the second evaporator;

a freezing-compartment expansion device that is coupled to the second heat exchanger and that is configured to expand the refrigerant and provide the expanded refrigerant to the second heat exchanger;

a valve device that couples the condenser to the second heat exchanger and that is configured to control an amount of the refrigerant provided from the condenser to the second heat exchanger;

a first expansion device that is coupled to a first outlet side of the valve device and that is configured to expand the refrigerant that is provided to the second heat exchanger;

a second expansion device that is coupled to an outlet side of the second heat exchanger and that is configured to expand the refrigerant that is output from the second heat exchanger; and a third expansion device that is coupled to a second outlet side of the valve device and that is configured to expand the refrigerant that bypasses the second heat exchanger.

19. The refrigerator of claim 18, wherein each of the first expansion device, the second expansion device, and the third expansion devices includes a respective capillary tube, and wherein a diameter of the capillary tube of the third expansion device is greater than a diameter of the capillary tube of the first expansion device or a diameter of the capillary tube of the second expansion device.

20. The refrigerator of claim 18, wherein the valve device includes a first valve including a first inlet, a first outlet, and a second outlet, and wherein the first valve is coupled to:

a first flow channel that extends from the first outlet of the first valve and that is coupled to the first expansion device, the second expansion device, and the second heat exchanger; and a second flow channel that extends from the second outlet of the first valve and that is coupled to the third expansion device.

21. The refrigerator of claim 20, further comprising:

a coupler that couples the first flow channel to the second flow channel, wherein the coupler is coupled to an inlet side of the second evaporator.

22. A refrigerator comprising:

a compressor configured to compress a refrigerant;

a condenser configured to condense the refrigerant;

a first evaporator that is configured to evaporate the refrigerant condensed by the condenser, the evaporated refrigerant being configured to cool a refrigerating compartment;

a second evaporator that is configured to evaporate the refrigerant condensed by the condenser, the evaporated refrigerant being configured to cool a freezing compartment;

a first heat exchanger coupled to the first evaporator;

a refrigerating-compartment expansion device that is coupled to the first heat exchanger and that is configured to expand the refrigerant and provide the expanded refrigerant to the first heat exchanger;

a second heat exchanger coupled to the second evaporator;

a freezing-compartment expansion device that is coupled to the second heat exchanger and that is configured to expand the refrigerant and provide the expanded refrigerant to the second heat exchanger; and a valve that includes a first inlet, a first outlet, a second outlet, and a third outlet, wherein the compressor includes a first compressor, and a second compressor configured to draw second refrigerant of the refrigerant and compress the second refrigerant, and wherein the first compressor is configured to (i) draw first refrigerant of the refrigerant, the first refrigerant being evaporated by the first evaporator and (ii) compress the first refrigerant and the second refrigerant, and wherein the valve is coupled to:

a first flow channel that extends from the first outlet of the valve to the first heat exchanger;

a second flow channel that extends from the second outlet of the valve to the second heat exchanger; and a third flow channel that extends from the third outlet of the valve to the second evaporator.

23. The refrigerator of claim 22, further comprising:

a refrigerating-compartment expansion device that is provided in the first flow channel and that is coupled to the first heat exchanger;

a first expansion device that is provided in the second flow channel and that is coupled to the second heat exchanger; and a second expansion device that is provided in the second flow channel and that is coupled to the second heat exchanger.

24. The refrigerator of claim 23, further comprising:

a third expansion device provided in the third flow channel.

* * * * *